US011576841B2

(12) United States Patent
Pollack et al.

(10) Patent No.: US 11,576,841 B2
(45) Date of Patent: Feb. 14, 2023

(54) HANDHELD MEDICAMENT DISPENSER

(71) Applicant: Bristol-Myers Squibb Company, Princeton, NJ (US)

(72) Inventors: Brandon J. Pollack, Princeton, NJ (US); Michael P. Stolz, Princeton, NJ (US)

(73) Assignee: Bristol-Myers Squibb Company, Princeton, NJ (US)

( * ) Notice: Subject to any disclaimer, the term of this patent is extended or adjusted under 35 U.S.C. 154(b) by 87 days.

(21) Appl. No.: 17/269,089

(22) PCT Filed: Aug. 27, 2019

(86) PCT No.: PCT/US2019/048219

§ 371 (c)(1),
(2) Date: Feb. 17, 2021

(87) PCT Pub. No.: WO2020/046851

PCT Pub. Date: Mar. 5, 2020

(65) Prior Publication Data

US 2021/0386626 A1 Dec. 16, 2021

Related U.S. Application Data

(60) Provisional application No. 62/723,666, filed on Aug. 28, 2018.

(51) Int. Cl.
*A61J 7/02* (2006.01)
*A61J 7/00* (2006.01)

(52) U.S. Cl.
CPC ..... *A61J 7/0076* (2013.01); *A61J 7/02* (2013.01)

(58) Field of Classification Search
CPC ..... A61J 7/0076
See application file for complete search history.

(56) References Cited

U.S. PATENT DOCUMENTS

| | | | | |
|---|---|---|---|---|
| 3,730,388 | A | 5/1973 | Bender | |
| 6,763,971 | B1 | 7/2004 | Tong | |
| 8,833,602 | B1 * | 9/2014 | Balasubramanian | G07F 17/0092 221/277 |
| 8,936,175 | B1 | 1/2015 | Song | |
| 2007/0186923 | A1 * | 8/2007 | Poutiatine | G16H 20/13 128/200.14 |
| 2009/0218363 | A1 * | 9/2009 | Terzini | B65B 5/103 221/4 |
| 2014/0138398 | A1 * | 5/2014 | Daniels | G07F 11/44 221/202 |
| 2015/0342830 | A1 | 12/2015 | Bujalski et al. | |
| 2016/0159555 | A1 | 6/2016 | Park | |

(Continued)

OTHER PUBLICATIONS

International Search Report and Written Opinion of the International Searching Authority from PCT International Application No. PCT/US2019/048219, dated Nov. 25, 2019.

*Primary Examiner* — Gene O Crawford
*Assistant Examiner* — Ayodeji T Ojofeitimi
(74) *Attorney, Agent, or Firm* — Budzyn IP Law, LLC

(57) ABSTRACT

The present invention relates to a hand-held medicament dispenser. The invention further relates to a hand-held medicament dispenser with an exchangeable cartridge contained therein. The invention further relates to uses of the medicament dispenser for counting and dispensing solid medicinal units.

57 Claims, 25 Drawing Sheets

(56) References Cited

U.S. PATENT DOCUMENTS

| | | | |
|---|---|---|---|
| 2017/0079887 | A1 | 3/2017 | Song |
| 2018/0147120 | A1 | 5/2018 | Poirier et al. |

* cited by examiner

HANDHELD MEDICAMENT DISPENSER

CROSS-REFERENCE TO RELATED APPLICATIONS

This application is a National Stage Application under 35 U.S.C. § 371 of PCT Application No. PCT/US2019/048219, filed Aug. 27, 2019, which claims the priority benefit of U.S. Provisional Application No. 62/723,666, filed Aug. 28, 2018; the content of which is herein incorporated by reference in its entirety.

BACKGROUND OF THE INVENTION

The vast majority of the medications are in solid dosage form. There are over a thousand different drugs that must be dispensed to patients in hospitals or pharmacies, and more are developed every year. Moreover, the quality control personnel in the pharmaceutical industry frequently need to collect a defined number of drug units from the production line in a manufacture setting. They are also required to accomplish the task with workwear including gloves which restrict their ability to handle small objects. Thus, dispensing or counting medications can be a time-consuming and error-prone operation. Accordingly, there is a need to dispensing of such drugs in a manner that is fast, efficient, and able to handle a wide range of different drugs.

Automated dispense of the medications has been developed. The most advanced of these incorporate robotic techniques to dispense tablets or capsules into vials. However, these automated medicament dispensers are usually bulky and expensive due to the complex system of the combined mechanical and electronic parts. Thus, it is desirable to provide a medicament-dispensing device that is compact and mobile, dispenses the drugs accurately and efficiently, and minimizes the possibility of human error.

SUMMARY OF THE INVENTION

Where terms are used below, in the description of the invention, to designate in particular structural elements of the subject matter according to the invention, such as "coupling means", "biasing means", and the like, these terms, irrespective of whether they are used in the singular or plural, are to be understood in the singular and in the plural.

In one embodiment, the present invention provides a medicament dispenser for solid medicinal units comprising a holding hopper having a wide opening end and a narrow opening end; a measurement chamber having a conduit with a top opening end and a bottom opening end, wherein the top opening end is aligned with the narrow opening end of the holding hopper; a top barrier which is located between the narrow opening end of the holding hopper and the top opening end of the measurement chamber, and is movable between a closed position and an open position; and a bottom barrier which is located beneath the bottom opening end of the measurement chamber, and is movable between a closed position and an open position.

In another embodiment, the present medicament dispenser further comprises an exchangeable cartridge which has an outside contour and an inside groove and is insertable to the conduit of the measurement chamber, wherein the inside groove has a shape and dimension suitable to measure a defined number of solid medicament units.

In yet another embodiment, the present medicament dispenser further comprises a bottom chamber with a top opening end and a bottom end, wherein the top opening end of the bottom chamber is aligned with the bottom opening end of the measurement chamber, and the bottom barrier is located between the bottom opening of the measurement chamber and the top opening end of the bottom chamber.

In one embodiment, the present invention provides a method of counting or dispensing a defined number of solid medicament units. The method comprises the steps of accumulating a sample of solid medicament units in a holding hopper; actuating a top barrier to move from a closed position to an open position to direct a defined number of solid medicament units to flow from the holding hopper into a measurement chamber having a conduit with a top opening end and a bottom opening end; actuating the top barrier to move from the open position to closed position to stop the solid medicament units to flow from the holding hopper into the measurement chamber; actuating a bottom barrier to move from a closed position to an open position to dispense the defined number of the solid medicament units from the measurement chamber. In one embodiment of the method, the measurement chamber contains an exchangeable cartridge inserted in the conduit, and the exchangeable cartridge has an outside contour and an inside groove.

In one embodiment, the present invention provides a medicament dispenser kit comprising a holding hopper having a wide opening end and a narrow opening end; one or more measurement chambers each having a conduit with a top opening end and a bottom opening end, wherein the top opening end of the measurement chamber is alignable with the narrow opening end of the holding hopper; a top barrier which is movable between a closed position and an open position when placed between the narrow opening end of the holding hopper and the top opening of the measurement chamber; and a bottom barrier which is movable between a closed position and an open position when placed at the bottom opening end of the measurement chamber.

In another embodiment, the medicament dispenser kit further comprises one or more exchangeable cartridges insertable to the conduit of the measurement chamber.

In another embodiment, the medicament dispenser kit further comprises a bottom chamber with a top opening end and a bottom end, wherein the top opening end of the bottom chamber is alignable with the bottom opening end of the measurement chamber.

In another embodiment, a plurality of bottom barriers may be used to allow for different quantities of solid medicament units to be accommodated in the measurement chamber.

In another embodiment, at least one height adjustable bottom barrier may be used to allow for different quantities of solid medicament units to be accommodated in the measurement chamber.

DETAILED DESCRIPTION OF THE INVENTION

Figure 1:
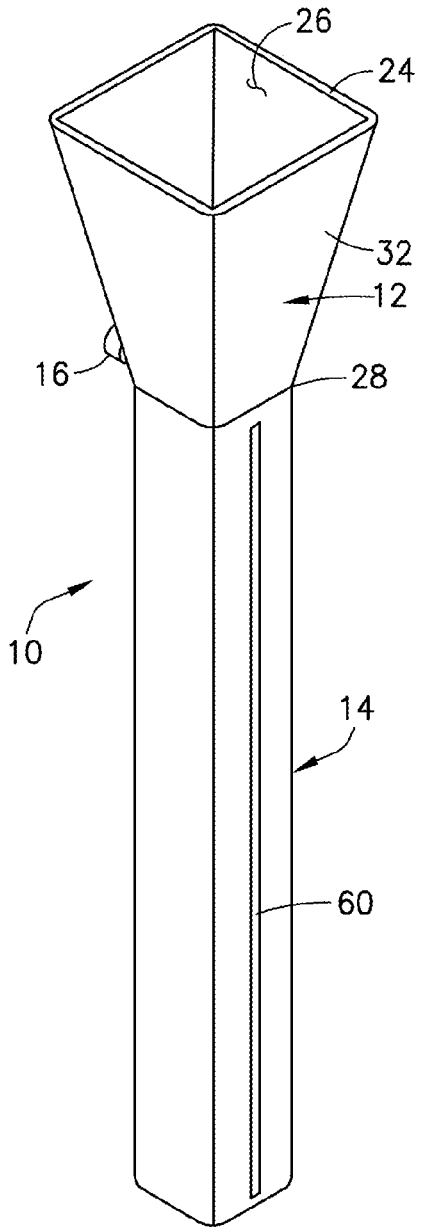
FIGS. 1 to 61 depict various elements and features of a medicament dispenser and its elements in accordance with the subject invention.
Figure 2:
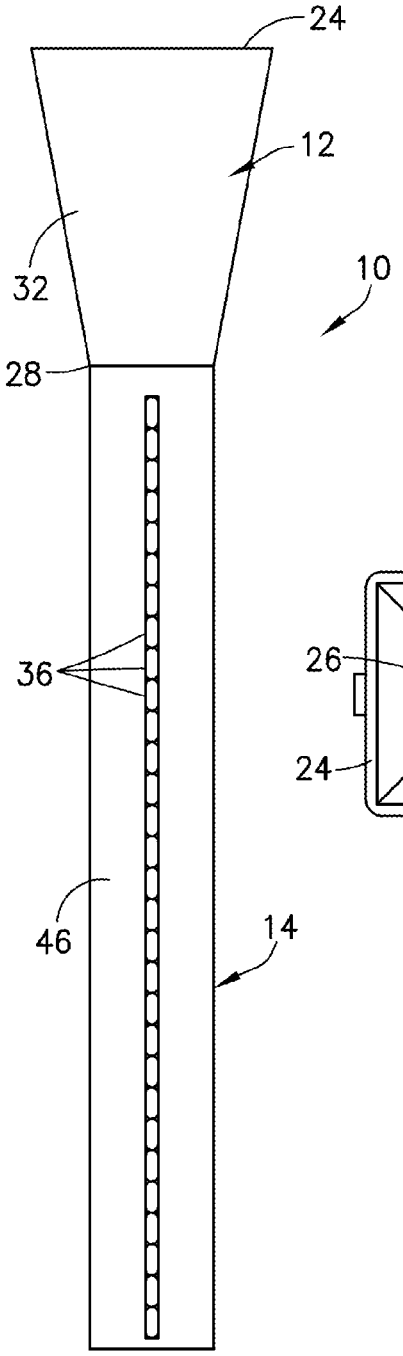

This invention relates to a medicament dispenser 10 for counting and/or dispensing solid medicinal units. The term "solid medicinal units" as used herein denotes a medicament in a solid dosage form, such as tablets, pills, capsules, tablets, lozenges, pellets, candies, and other solid presentation forms. The solid dosage form can be coated or uncoated.

The medicament dispenser is a hand-held device for counting or dispensing solid medicinal units. In one embodiment, the medicament dispenser has no electrical component and can be conveniently operated by a user without external electric power source.

In one embodiment, the medicament dispenser 10 comprises a holding hopper 12, a measurement chamber 14, and a top barrier 16. In another embodiment, the medicament dispenser 10 further comprises an exchangeable cartridge 62 insertable into the measurement chamber 14. In another embodiment, the medicament dispenser 10 further comprises a bottom barrier 20 and, optionally, a bottom chamber 22. The medicament dispenser 10 can be readily assembled by joining the holding hopper 12 and the measurement chamber 14.

Figure 3:
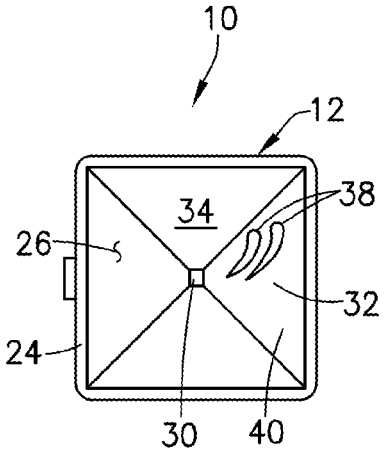
Figure 4:
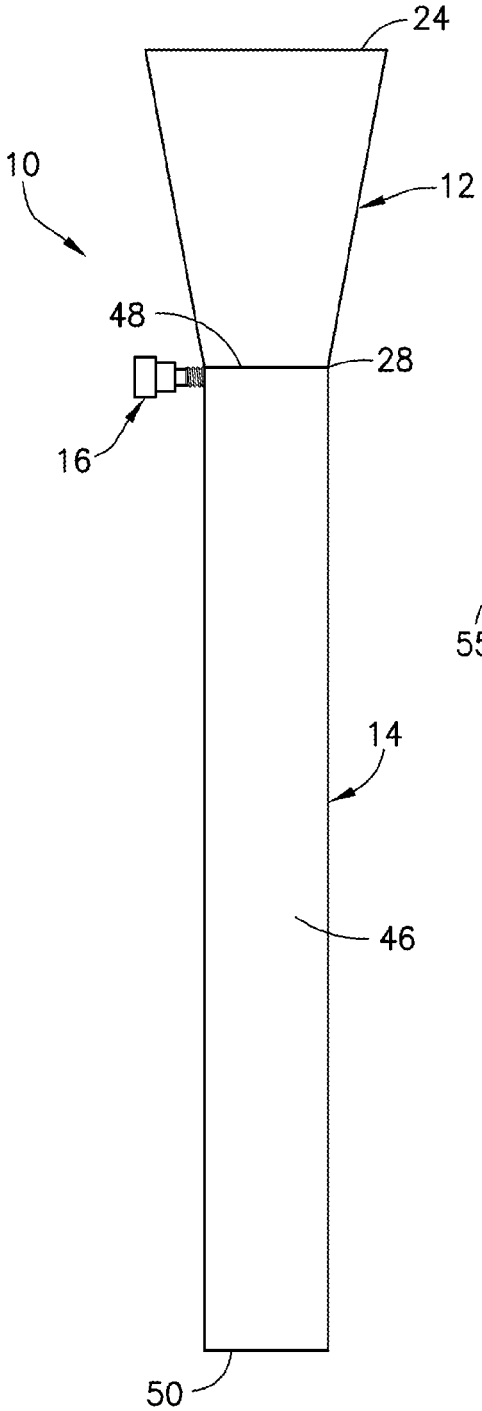
Figure 5:
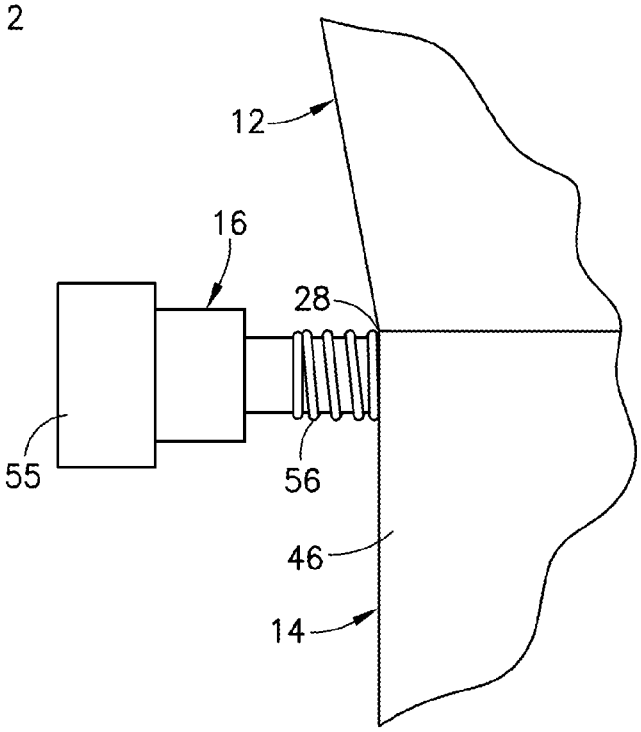

In one embodiment, the holding hopper 12 has a wide end 24 defining an inlet opening 26 and a narrow end 28 defining an outlet opening 30. The two ends 24, 28 and a surrounding wall 32 form a truncated cone-shaped or funnel-shaped internal channel 34. When a sample of solid medicinal units 36 are dispersed for counting or dispensing, they are received through the inlet opening 26 of the holding hopper 12 and accumulated towards the narrow end 28. In one embodiment, the holding hopper 12 has a directing means 38 in the internal channel 34. Such directing means 38 facilitates the flow of the solid medicinal units 36 towards the narrow end 28 and the eventual entry of the solid medicinal units 36 into the measurement chamber 14. For example, the directing means 38 can be one or more curved or spiral bumper strips on inner surface 40 of the surrounding wall 32 (shown schematically in FIG. 3). In addition, or alternatively, as shown in FIGS. 46-50, the directing means 38 may be provided as a separate element, such as coil 33, formed to define a downward helical pathway for guiding the solid medicinal units 36 towards the narrow end 28. The coil 33 may be retained in the internal channel 34 in any known manner, including being snap-fit into the holding hopper 12. The coil 33 may be elastically deformable to compress in response to a container or other structure being coupled to the wide end 24, as discussed below. The coil 33 may be metallic and be removable from the holding hopper 12 for cleaning. In addition, or alternatively, the solid medicinal units 36 may be agitated, e.g., by shaking the medicament dispenser 10 or stirring the solid medicinal units 36 with a mixing stick or paddle, to facilitate their movement towards the narrow end 28.

Figure 12:
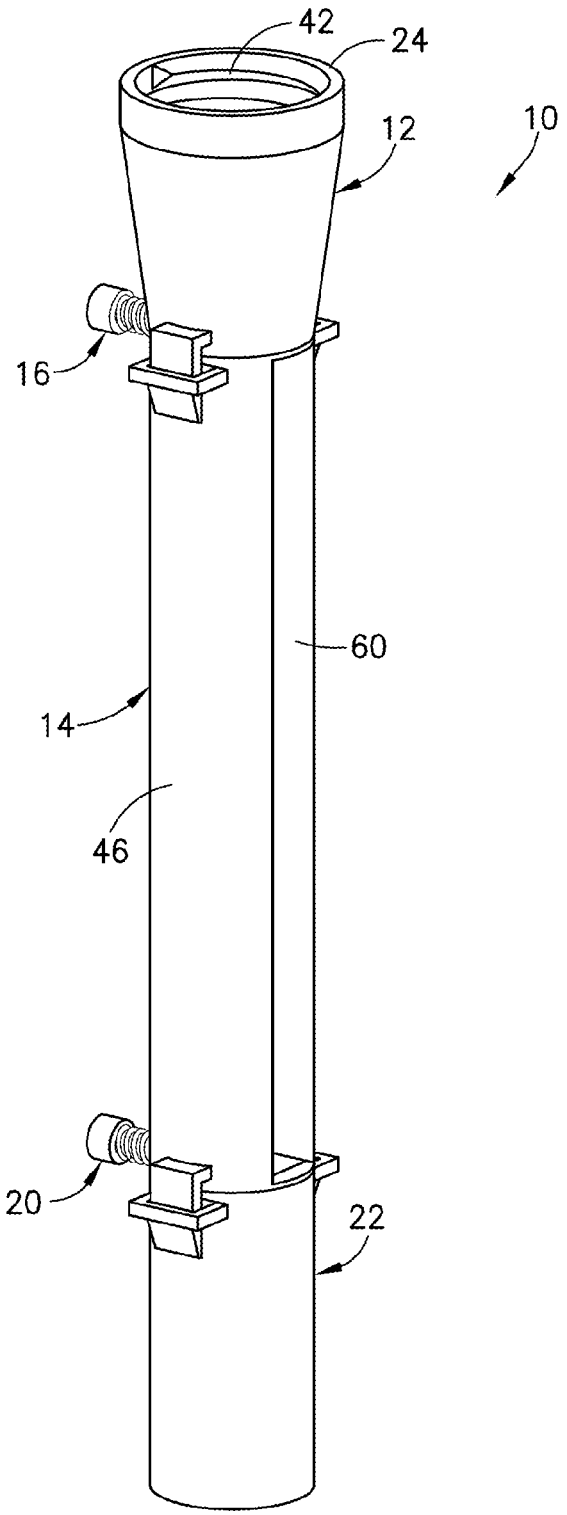
Figure 14:
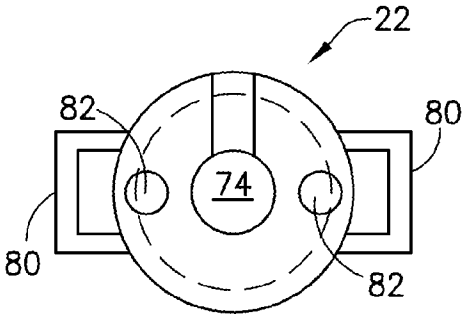
Figure 15:
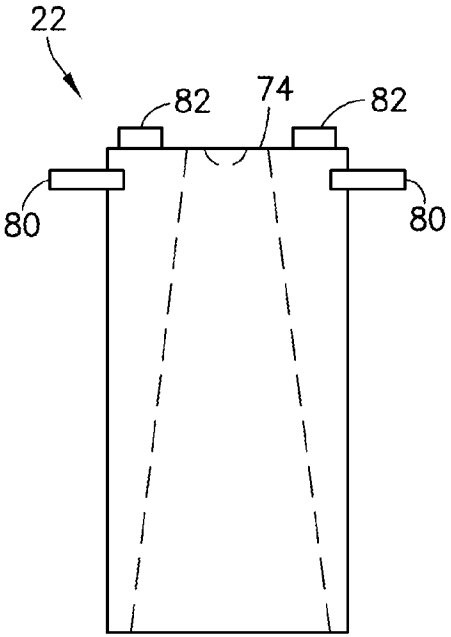

In one embodiment, the holding hopper 12 has a coupling means 42 at the wide end 24, e.g., at or adjacent to the inlet opening 26 (FIG. 12). Such coupling means 42 may be used to affix a cap, lid, a container, or other secondary structure to the wide end 24. For example, the coupling means may be one or more male or female thread elements, detents, snap-engagement elements, dimensioning to permit a friction fit, dimensioning to permit an interference fit, and/or bayonet-locking elements. The affixed cap, lid, or container may be used to prevent the solid medicinal units 36 from falling out of the holding hopper 12, thus, protecting the solid medicinal units 36 from potential external contamination. In another embodiment, the holding hopper 12 may be provided with the coupling means 42 at the narrow end 28 at or adjacent to the outlet opening 28 to facilitate affixing the holding hopper 12 to the measurement chamber 14.

Figure 6:
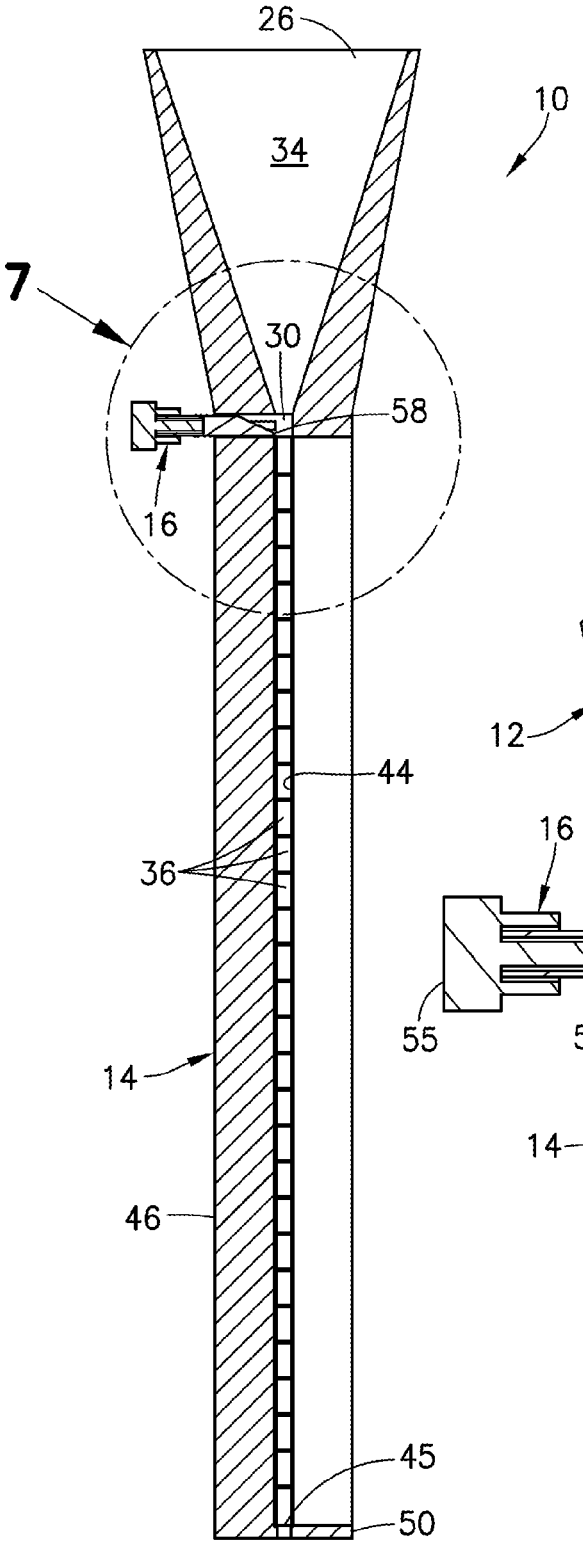
Figure 7:
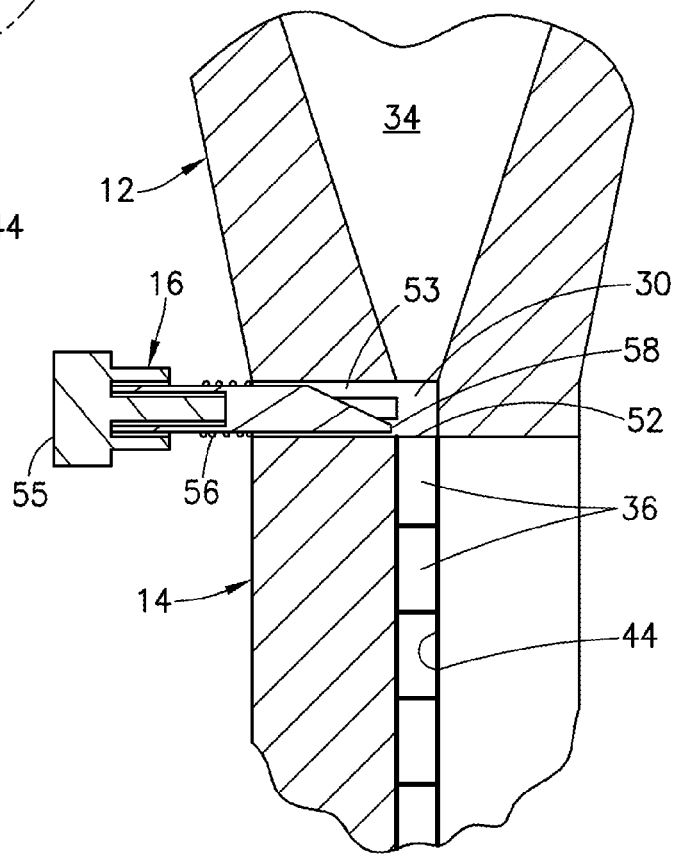

The measurement chamber 14 may have an inside conduit 44 and a surrounding wall 46 which extends between top and bottom ends 48, 50 of the measurement chamber 14. The conduit 44 is elongated and extends in an axial direction from a top opening 52, which preferably coincides with the top end 48. In this embodiment, as shown in FIG. 6, the conduit 44 may terminate at a solid bottom 45, which may coincide with the bottom end 50. The conduit 44 is configured to accommodate a stack of the solid medicinal units 36 (FIG. 6). With the holding hopper 12 joined to the measurement chamber 14, the internal channel 34 is aligned with the conduit 44 to allow the solid medicinal units 36 to pass from the holding hopper 12 into the conduit 44. The surrounding wall 46 may have an outside contour of any shape suitable for holding by a user's hands, such as being round, square, oval, etc.

Figure 37:
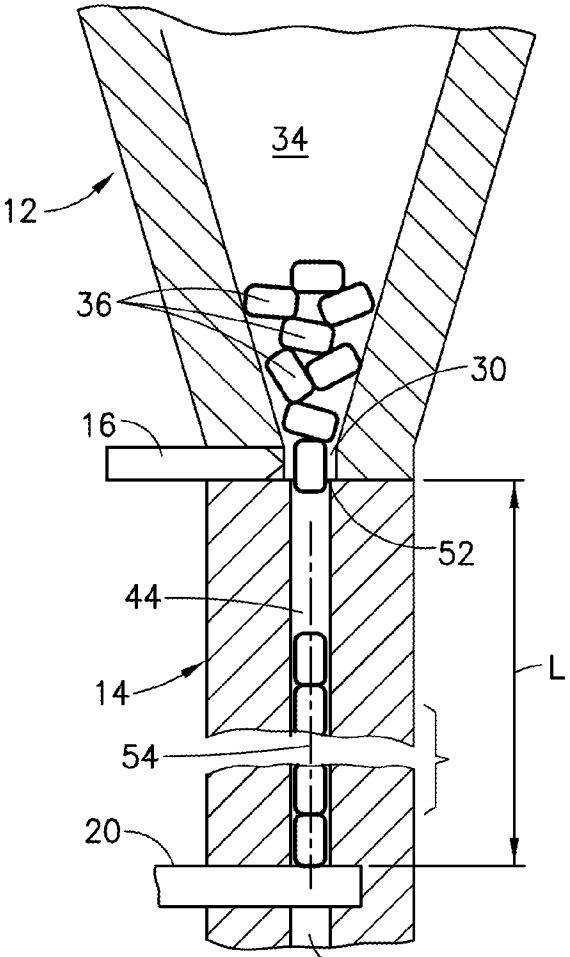
Figure 36:
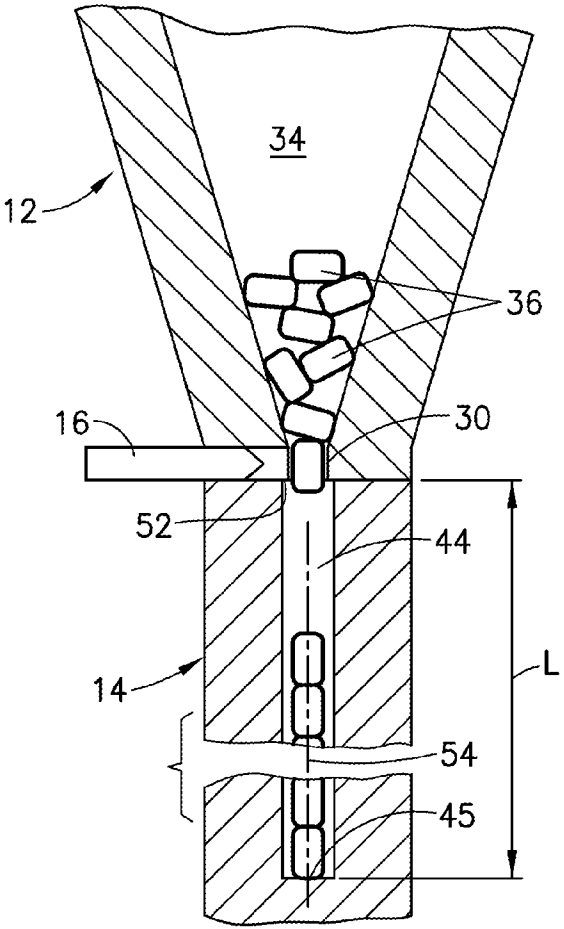

The outlet opening 30 and/or the top opening 52 is preferably cross-sectionally formed such that the solid medicinal units 36 may only pass therethrough in one orientation. For example, with the solid medicinal units 36 being elongated, the outlet opening 30 and/or the top opening 52 is formed with a footprint which permits the solid medicinal units 36 to each pass with its longitudinal axis 54 coinciding with the conduit 44 while preventing passage therethrough of the solid medicinal units 36 oriented in any other alignment. In this manner, as shown in FIGS. 36 and 37, the length L (e.g., as measured between the top opening 52 and the solid bottom 45 or the bottom barrier 20) of the conduit 44 may be set to correspond to a target number of the solid medicinal units 36. In other words, with the solid medicinal units 36 being similarly dimensioned, the length L of the conduit 44 defines the number of the solid medicinal units 36 that may be accommodated in the conduit 44. It is noted that the length L may be less than the length of the measurement chamber 14. As shown in FIG. 36, the outlet opening 36 may be formed smaller than the top opening 52, thereby providing orientation to the solid medicinal units 36. Conversely, as shown in FIG. 37, the top opening 52 may be formed smaller than the outlet opening 36 to facilitate orienting the solid medicinal units 36. It is possible for both openings 36 and 52 to be sized the same.

Figure 38A:
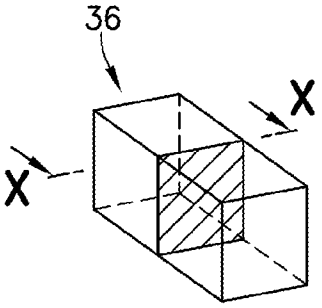
Figure 38B:
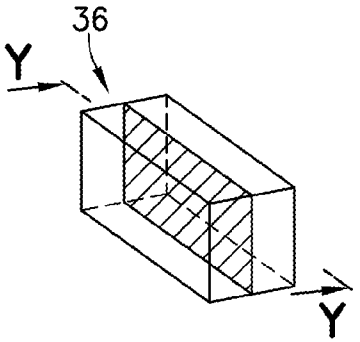
Figure 38C:
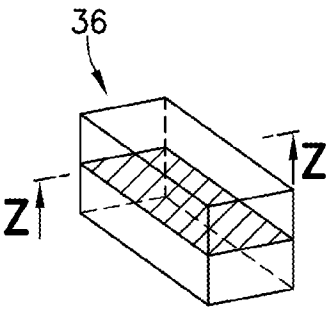

As shown in FIGS. 38A, 38B and 38C, each of the solid medicinal units 36 has a maximum cross-section in each Cartesian coordinate, as defined by a X-X plane, a Y-Y plane, and a Z-Z plane. It is preferred that for a given shape of a solid medicinal unit 36, the outlet opening 30 and/or the top opening 52 is configured to match (with slight clearance) the smallest of the three maximum cross-sections (e.g., the cross-section corresponding to the X-X plane in FIG. 38A). The maximum cross-section in more than one plane may be equal, e.g., if the solid medicinal units 36 are spherical.

The conduit 44 preferably is cross-sectionally formed to generally the cross-section of the outlet opening 30 and/or the top opening 52 used for orienting the solid medicinal units 36. In this manner, the orientation of the solid medicinal units 36 may be maintained in the conduit 44. If the conduit 44 is made too large cross-sectionally relative to the outlet opening 30 and/or the top opening 52 used for orienting the solid medicinal units 36, the solid medicinal units 36 may be inadvertently re-oriented in the conduit 44 in an undesired orientation, thereby, disrupting predictable stacking of the solid medicinal units 36 in the conduit 44.

Figure 8:
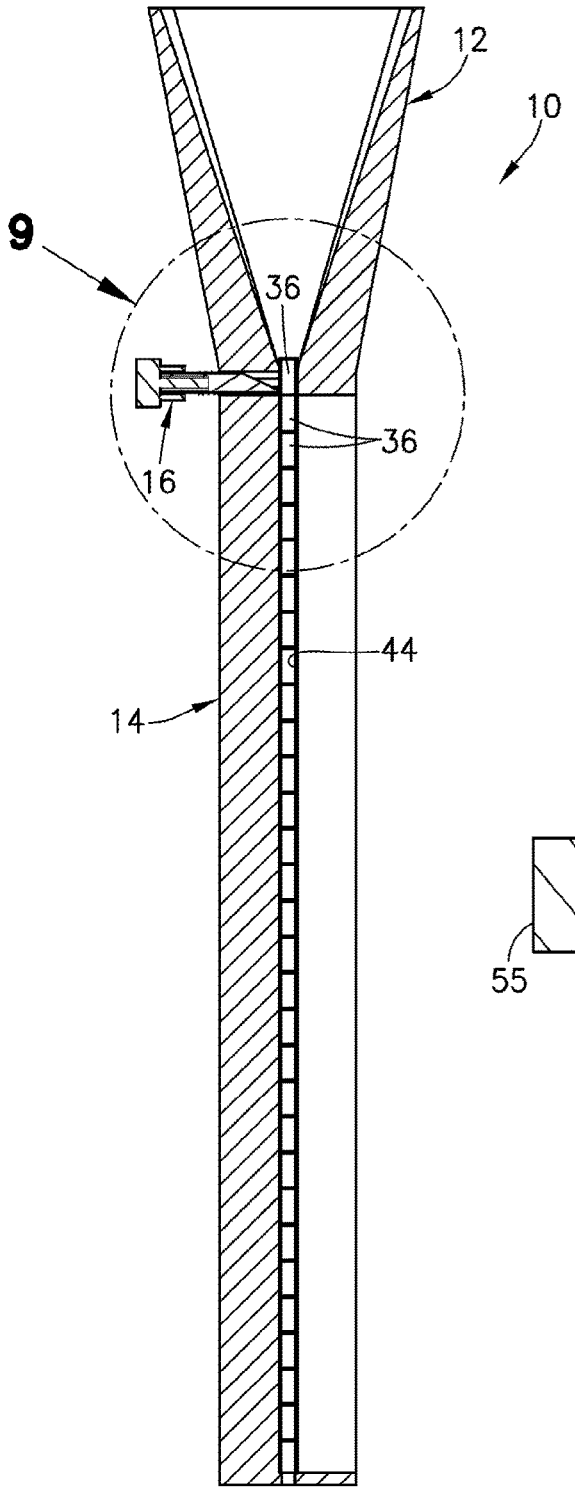
Figure 9:
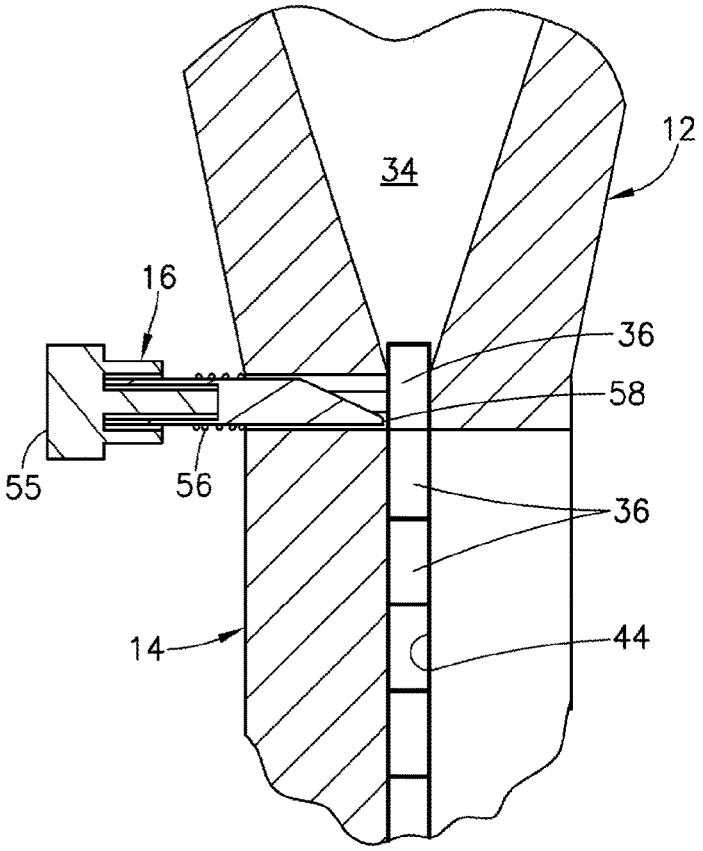
Figure 10:
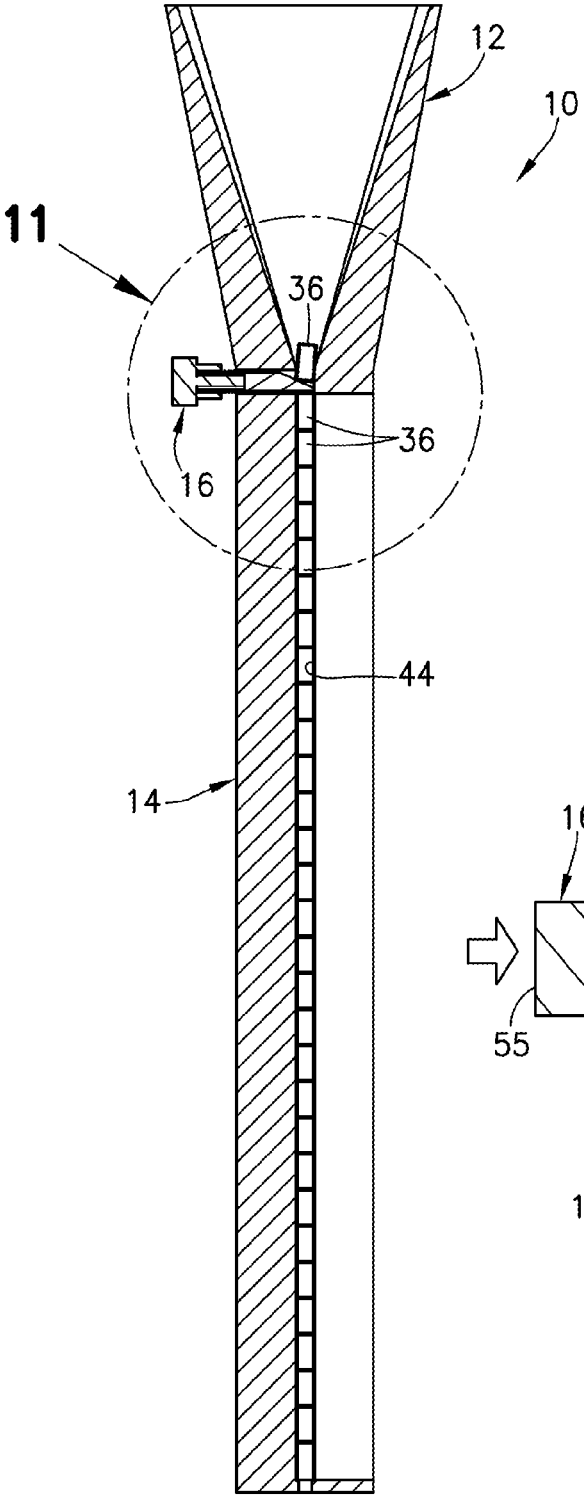
Figure 11:
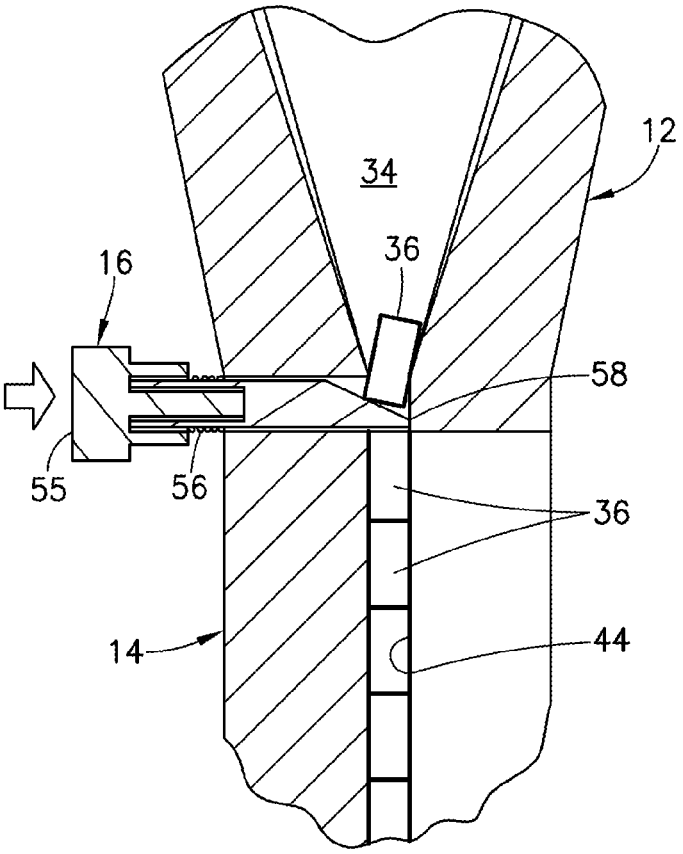

The top barrier 16 may be located at or adjacent the juncture of the narrow end 28 of the holding hopper 12 and the top end 48 of the measurement chamber 14. The top barrier 16 can move between a closed position and an open position. The top barrier 16 may be maintained in a normally open state via a biasing means 56. Examples of the biasing means 56 include springs, clips, deflectable members, bumpers, and the like. The top barrier 16 may be formed to extend out of a channel 53 which extends through the surrounding wall 46 into communication with the internal channel 34. The top barrier 16 may also have a button 55 or other member formed to be engageable by a user. The biasing means 56 may be located to act against an external portion of the surrounding wall 46 in applying biasing force against the button 55 or other portion of the top barrier 16. A portion of the top barrier 16 may pass through the biasing means 56 to provide retention and/or stability therefor. With this embodiment, and as shown in FIGS. 8-9, when not actuated, the top barrier 16 is biased to an open position not blocking passage of any solid medicinal units 36 between the holding hopper 12 and the conduit 44. Upon actuation, as shown in FIGS. 10-11, the top barrier 16 can be moved to a closed position blocking the conduit 44, for example, as a result of force applied thereto in a direction towards the conduit 44. As can be seen in comparing FIGS. 8 and 9 with FIGS. 10 and 11, the closing of the top barrier 16 provides for separating any excess units of the solid medicinal units 36 beyond the target number intended for the conduit 44. It is preferred that the top barrier 16 be located to pass just above the conduit 44 to allow for this separating action. Preferably, the top barrier 16 is provided with a tapered leading edge 58 or a flat edge to act as a wedge in better facilitating the separation of the solid medicinal units 36.

Figure 17:
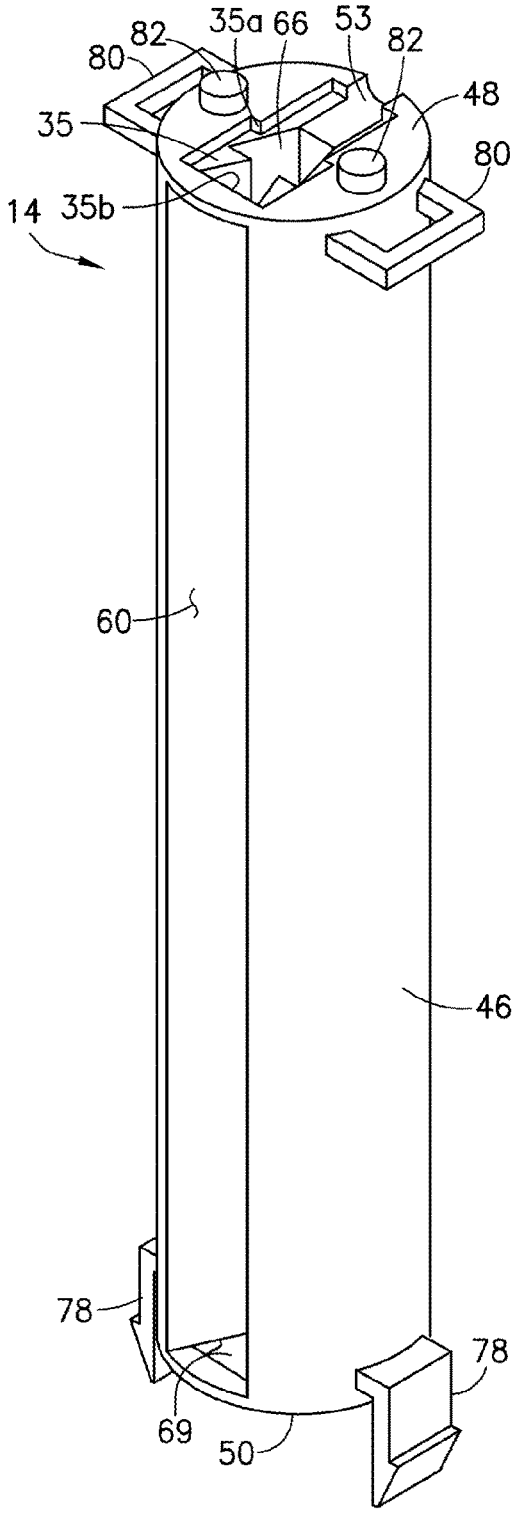
Figure 18:
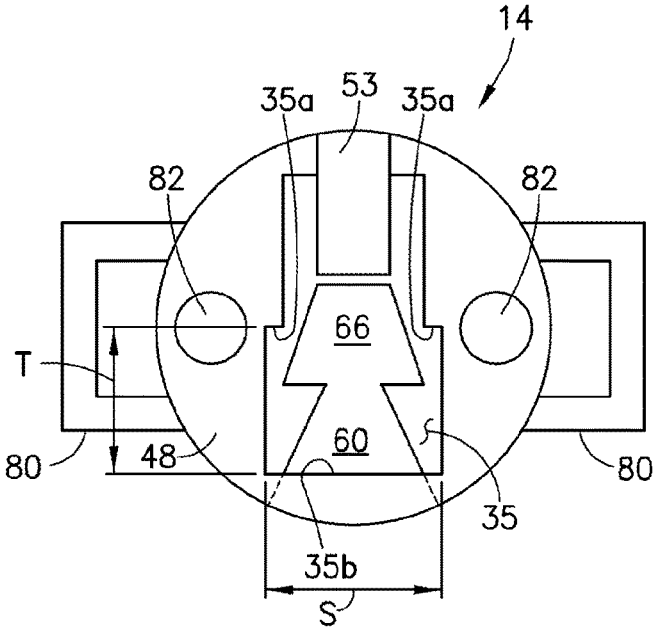
Figure 19:
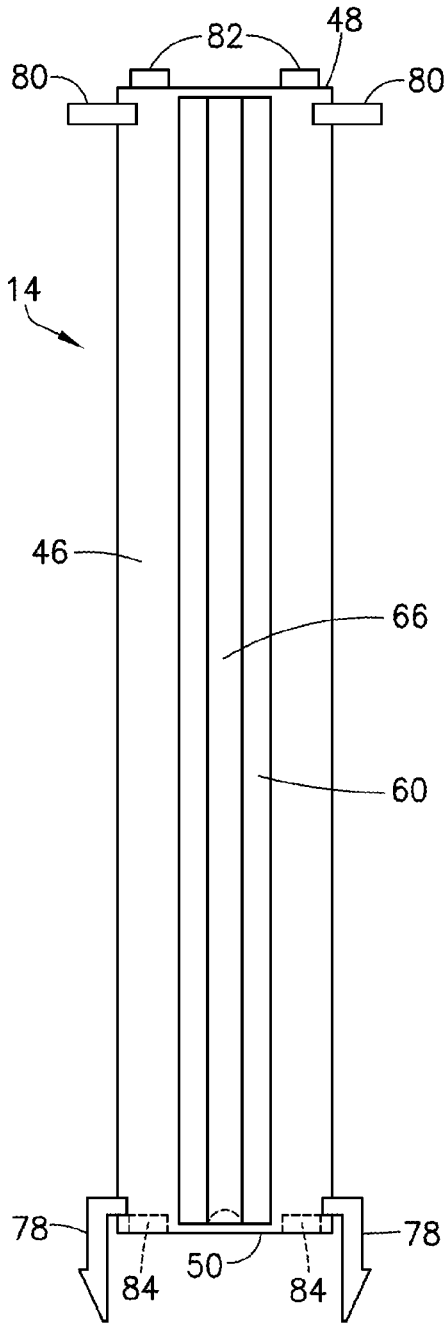
Figure 20:
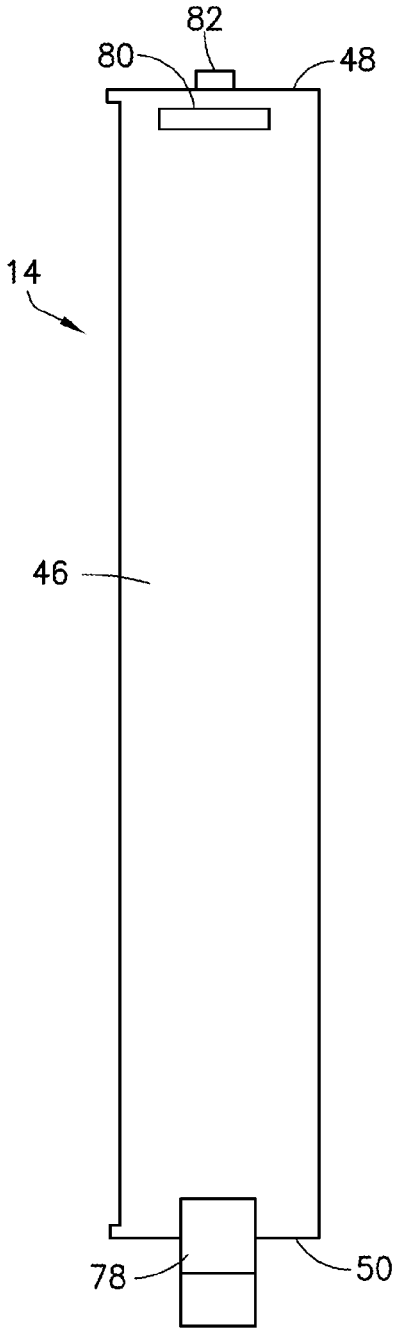

With reference to FIGS. 17 and 18, an indented seat 35 may be defined in the top end 48 of the measurement chamber 14 formed to accommodate the top barrier 16. Preferably, the indented seat 35 includes a width S equal to or greater than the top barrier 16 and a length T greater than the top barrier 16 to permit sliding movement of the top barrier 16 within the indented seat 35. The channel 53 extends from the indented seat 35 and through the external wall 46.

The indented seat 35 includes first shoulder 35*a* which limits movement of the top barrier 16 towards the channel 53, and a second shoulder 35*b* which limits movement of the top barrier 16 away from the channel 53. The length T may be defined between the first and second shoulders 35*a*, 35*b*. The first and second shoulders 35*a*, 35*b* delimit the range of movement of the top barrier 16. In addition, the first and second shoulders 35*a*, 35*b* act against any biasing force applied to the top barrier 16 to provide a normally open position (e.g., the top barrier 16 being urged to press against the first shoulder 35*a*) or normally closed position (e.g., the top barrier being urged to press against the second shoulder 35*b*).

As shown in the Figures, the holding hopper 12 is located above and acts to limit the unseating of the top barrier 16 from the indented seat 35. As shown in FIGS. 46-49 and 51-53, an insert plate 100 may be provided between the measurement chamber 14 and the holding hopper 12 to restrict unseating of the top barrier 16 from the indented seat 35. The insert plate 100 may be metallic. In addition, the insert plate 100 may include a central aperture 102 having an inner tapered surface 104. The central aperture 102 is sized and positioned to coincide with outlet opening 30 of the holding hopper 12. In addition, the tapered surface 104 may be tapered to match the taper of the internal channel 34. The central aperture 102 may be considered at least a part (possibly the entirety) of the outlet opening 30, providing the orientation function described above in connection with the outlet opening 30 and/or the top opening 52.

An upright locking tab 106 may be provided on the insert plate 100 to limit rotation relative to the holding hopper 12 and/or the measurement chamber 14. In addition, slot 108 may be provided in a lower face 110 of the insert plate 100 shaped to coincide with the channel 53. The slot 108 provides clearance as needed for the button 55. The lower face 110 of the insert plate 100 coincides with the narrower opening of the central aperture 102.

Figure 49:
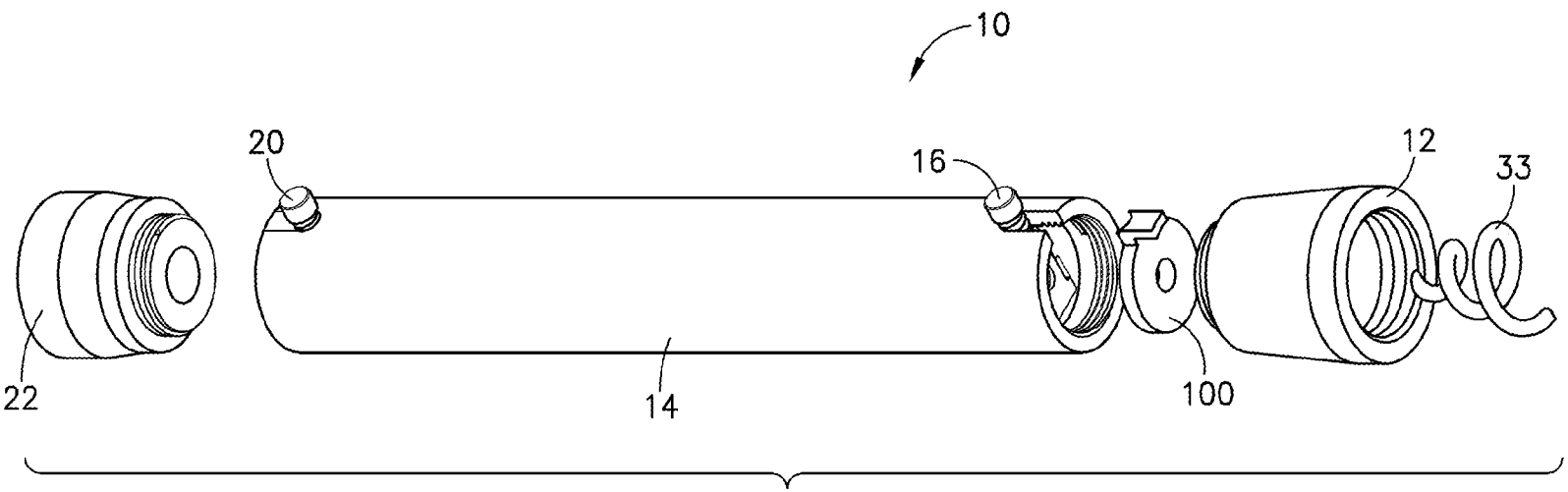
Figure 51:
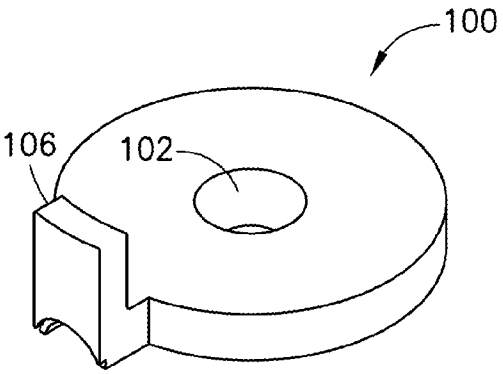
Figure 53:
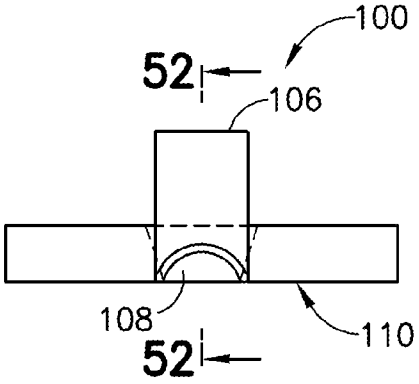
Figure 50:
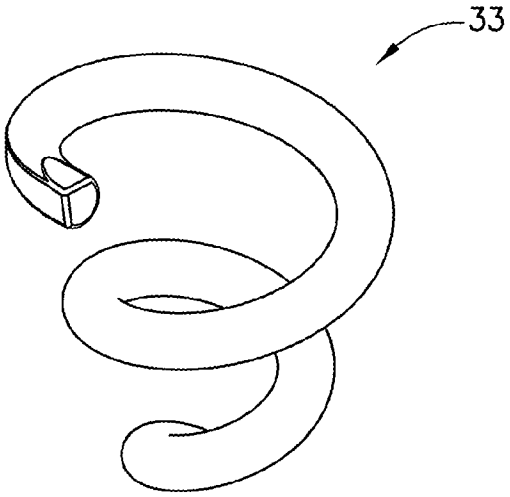
Figure 52:
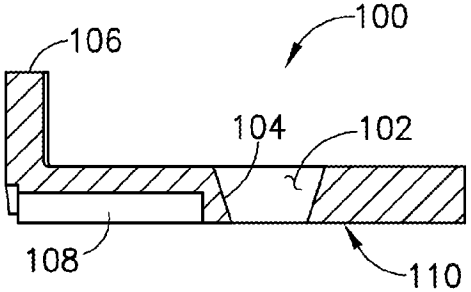
Figure 54:
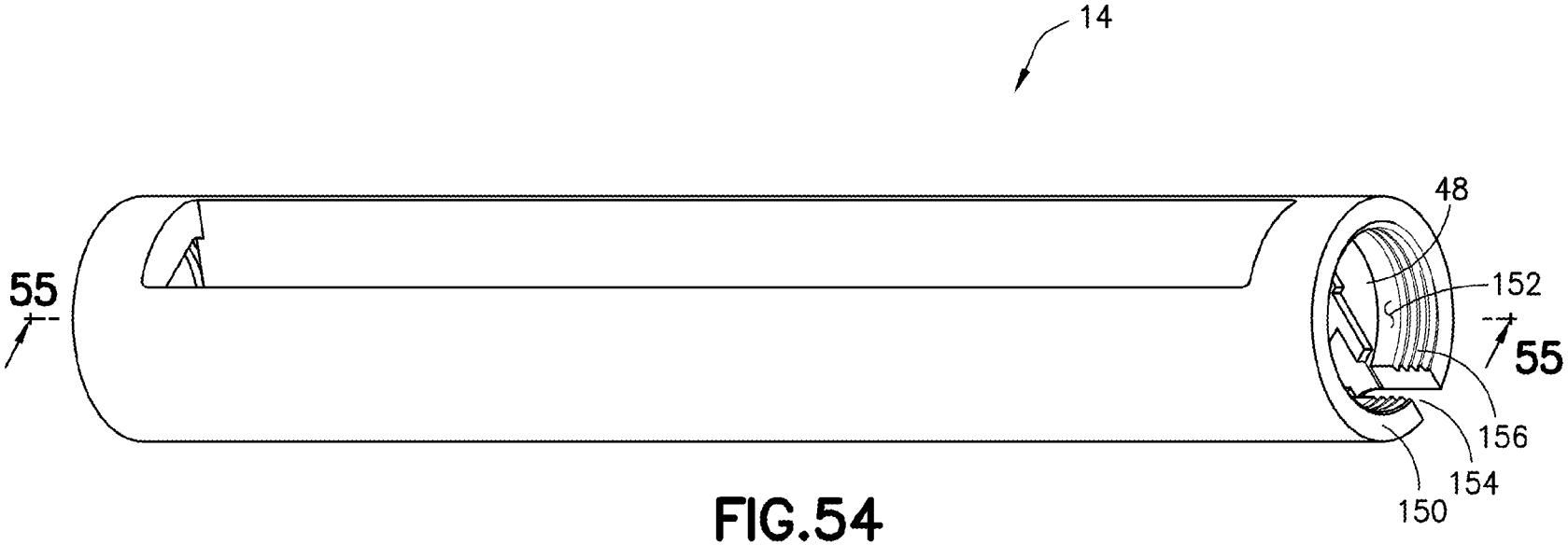
Figure 55:
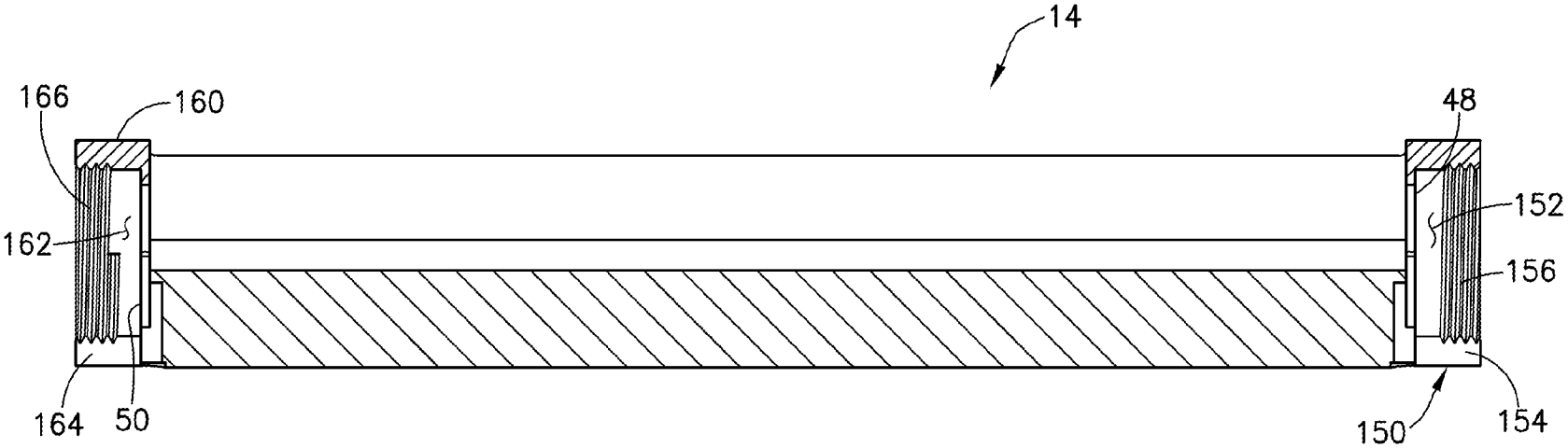
Figure 56:
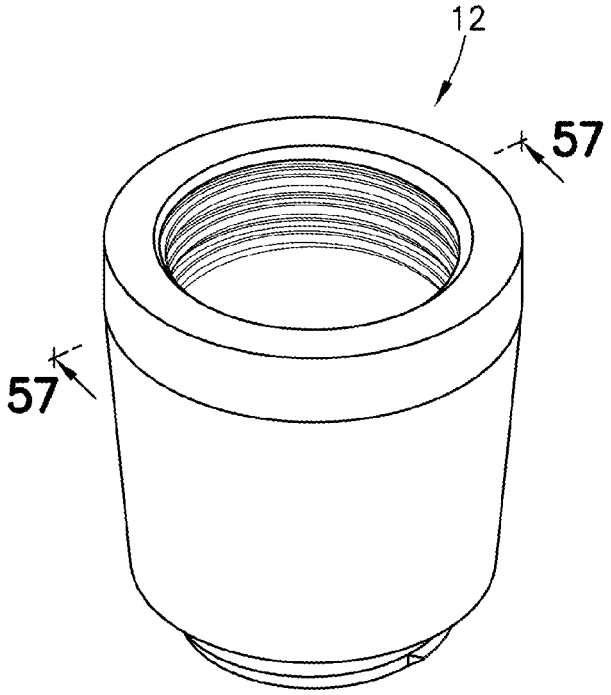
Figure 57:
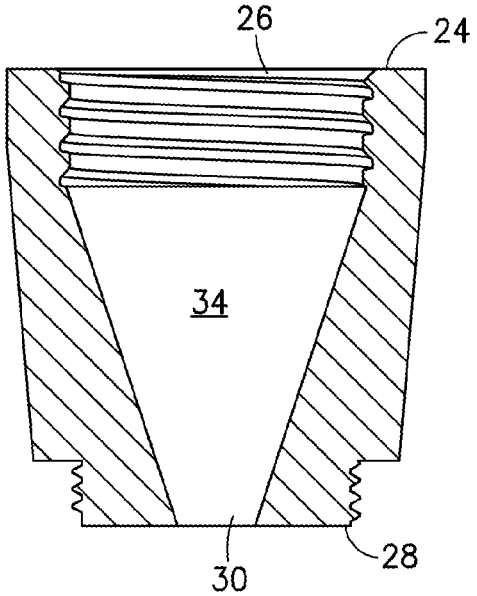
Figure 58:
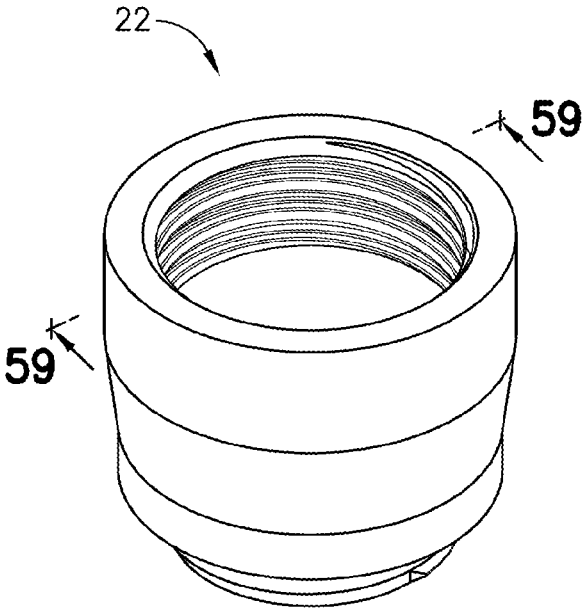
Figure 59:
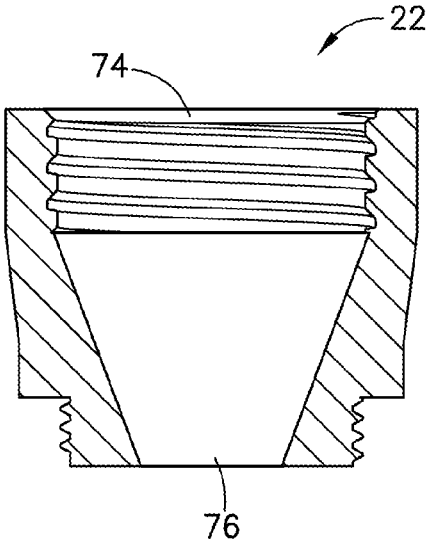

As shown in FIGS. 54-55, the measurement chamber 14 may be formed with a mounting wall 150 which protrudes from the top end 48. The mounting wall 150 may define a recess 152 for accommodating the insert plate 100 with lock opening 154 formed to accommodate the locking tab 106 (FIG. 49). Preferably, a clearance is provided between the top barrier 16 and the insert plate 100 to avoid direct surface-to-surface moving interactions. In addition, inner surface 156 of the mounting wall 150 may be provided with the coupling means 42, e.g., being threaded to allow for threaded mounting of the holding hopper 12 thereto.

In use, the solid medicinal units 36 are introduced into the holding hopper 12. With the top barrier 16 being in an open position, as shown in FIGS. 36 and 37, the solid medicinal units 36 are directed to enter the conduit 44 in a particular orientation with resulting orderly stacking in the axial direction. With a sufficient number of the solid medicinal units 36 being introduced into the conduit 44, the target number will be reached and exceeded. With such excess, the user urges the top barrier 16 closed to separate the excess from the column of the solid medicinal units 36 accommodated in the conduit 44. With the top barrier 16 remaining closed, the excess solid medicinal units 36 may be removed from the holding hopper 12. Thereafter, the top barrier 16 may be released to allow its opening. Once opened, the medicament dispenser 10 may be inverted with the solid medicinal units 36 being dispensed therefrom in a known, target quantity.

A visualization window 60 may be provided through the surrounding wall 46 which permits viewing the solid medicinal units 36 from the outside. This permits a visual check of the filling level of the conduit 44. In one embodiment, the visualization window 60 may be an open slot (FIG. 12) which extends through the surrounding wall 46. In another embodiment, the visualization window 60 may be one or more panes made at least partially of a transparent or translucent material (FIG. 1). In yet another embodiment, the surrounding wall 46 may be formed partially or wholly transparent or translucent.

Figure 21:
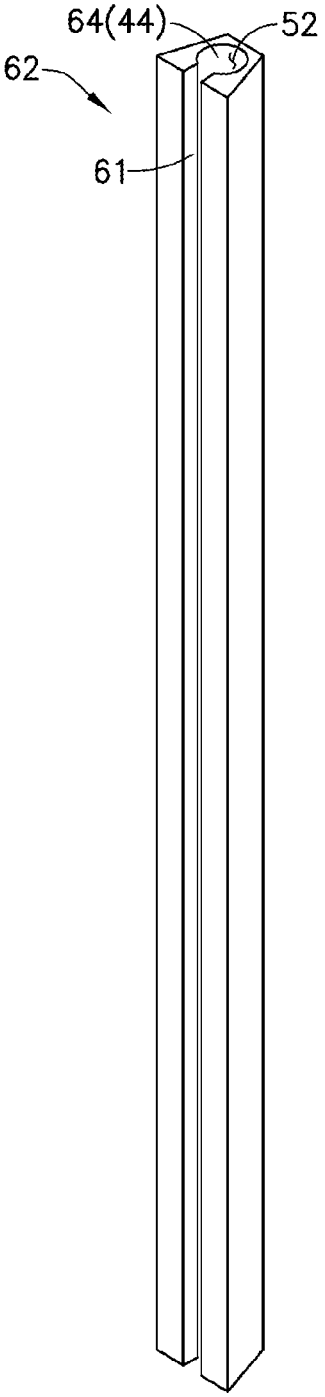
Figure 22:
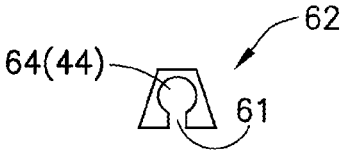
Figure 23:
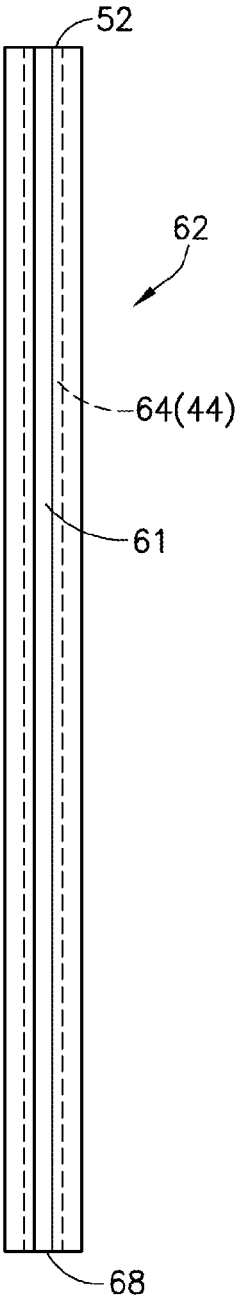
Figure 25:
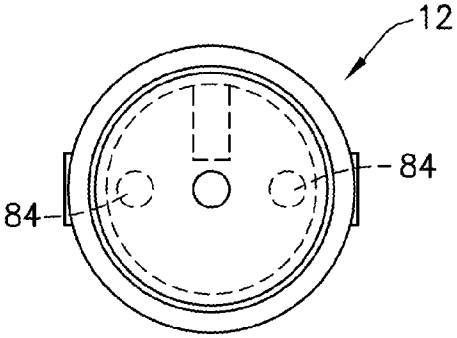
Figure 27:
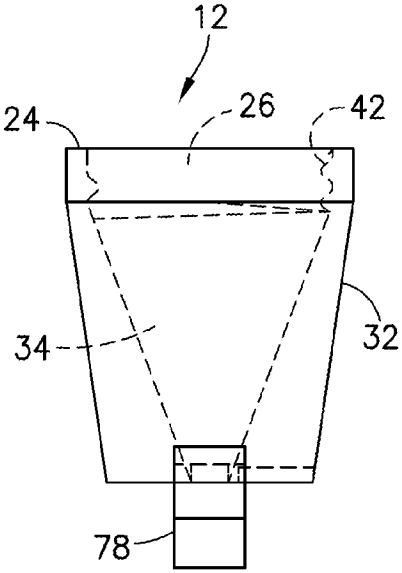
Figure 26:
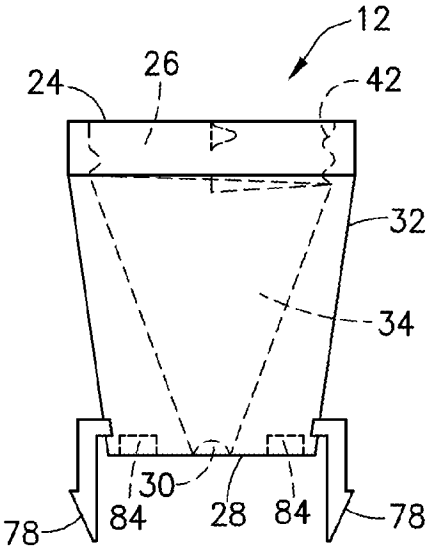
Figure 24:
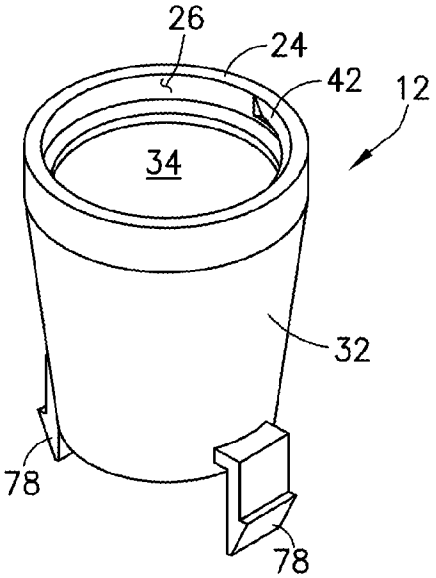
Figure 29:
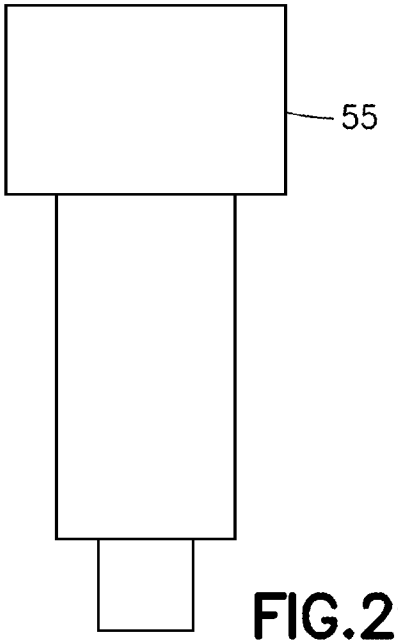
Figure 30:
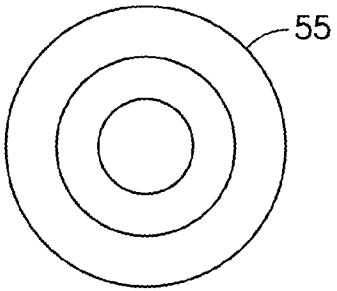
Figure 28:
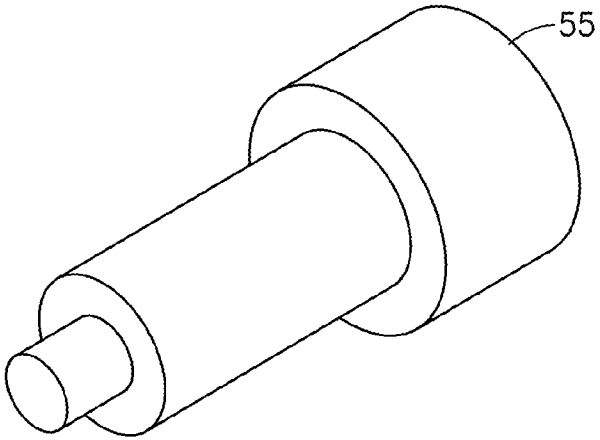
Figure 32:
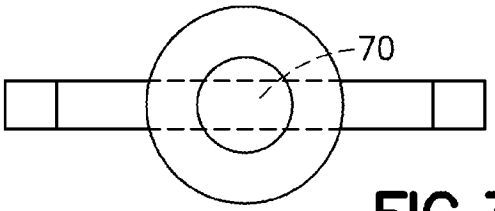
Figure 33:
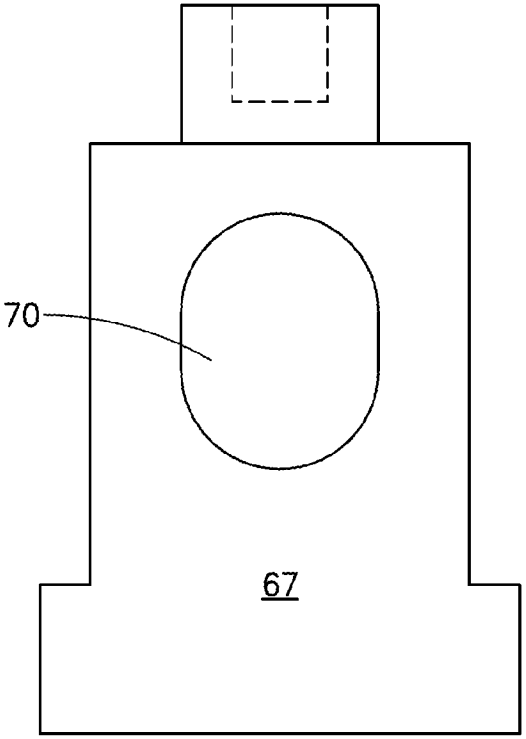
Figure 31:
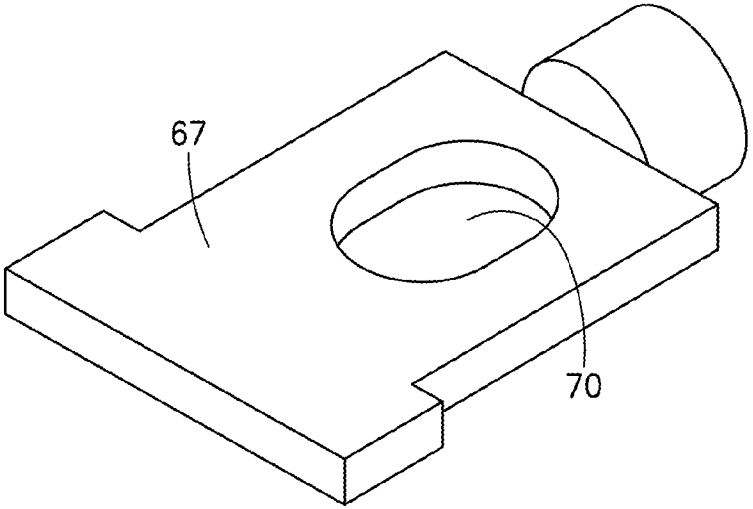
Figure 34:
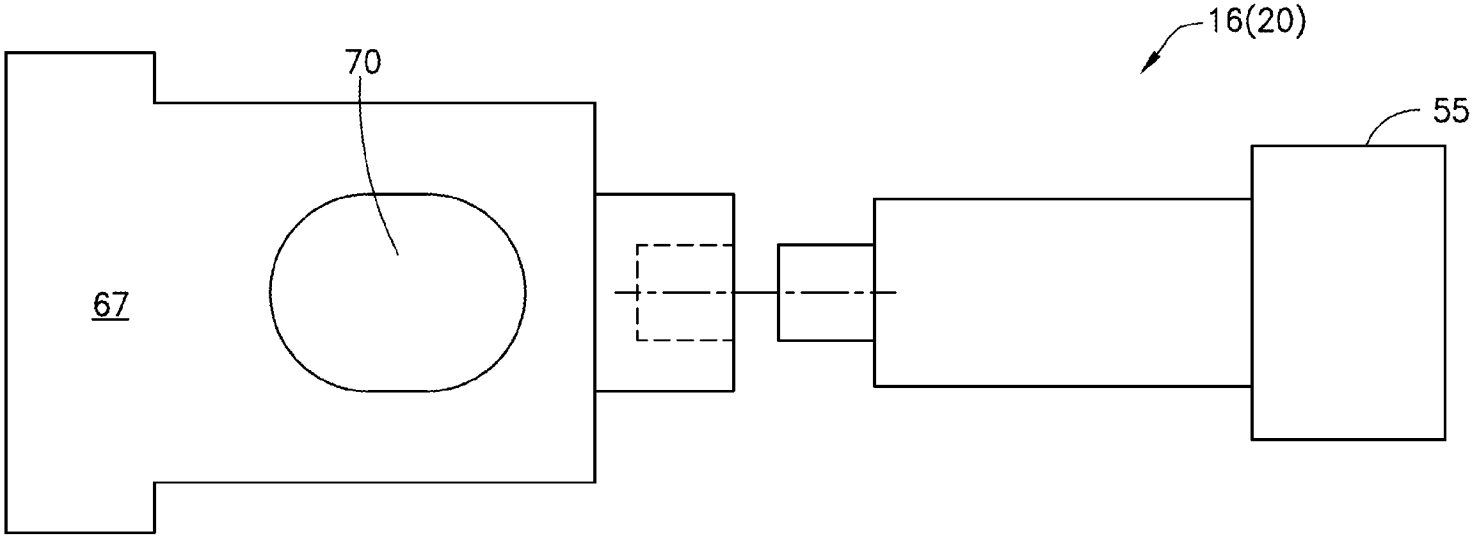
Figure 35:
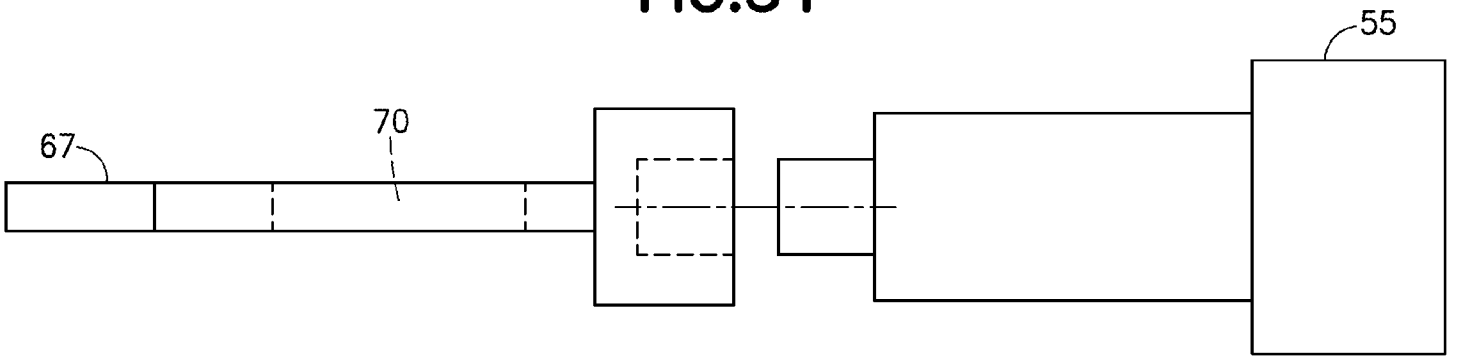

The medicament dispenser 10 may further comprise an exchangeable cartridge 62 (FIGS. 21-23). The cartridge 62 includes an inner lumen 64 which defines the conduit 44 and the top opening 52. The cartridge 62 is insertable into an open channel 66 formed in the measurement chamber 14 (FIGS. 17-20). Preferably, the cartridge 62 is removable from the open channel 66 to allow for multiple cartridges 62 to be used with the measurement chamber 14. In this manner, the lumen 64 may be configured differently amongst the cartridges 62 to permit different cross-sectional configurations of the conduit 44 and the top opening 52. In this manner, the measurement chamber 14 may be configured to accommodate differently-shaped solid medicinal units. The outlet opening 30 may be formed larger than any of the top openings 52 of the cartridges 62 to allow the top openings 52 to orient the solid medicament units 36. The outside contour of the cartridge 62 has a shape and dimension fitting to the shape and dimension of the open channel 66 of the measurement chamber 14 so that the cartridge 62 can be removably inserted axially into the open channel 66. Preferably, the cartridge 62 is configured to interferingly and/or frictionally engage the surrounding wall 46 within the open channel 66 to provide retentive holding force therefor. The cartridge 62 may be provided with a cartridge window 61 which may be formed in similar fashion to the window 60 as described above. Preferably, the cartridge window 61 is positioned in alignment with the window 60 to allow for a user to view through the surrounding wall 46 and through the cartridge 62.

The conduit 44 may be formed open at both ends with dispense opening 68 being provided in place of solid bottom 45. The bottom barrier 20 may be located beneath the dispense opening 68 to selectively regulate dispensing of solid medicinal units 36 from the conduit 44. The bottom barrier 20 may be configured in the same manner as the top barrier 16 described above. With the bottom barrier 20 closed, and the target number of the solid medicinal units 36 in the conduit 44, the bottom barrier 20 may be actuated to open to allow for dispensing of the solid medicinal units 36 from the conduit 44. This obviates the need to empty the holding hopper 12 for dispensing. With the cartridge 62 defining the conduit 44, opening 69 may be formed in the measurement chamber 14 below the open channel 66 to align with the dispense opening 68.

The bottom end 50 of the measurement chamber 14 may be provided with the indented seat 35 for the bottom barrier 20, in the same configuration as described above with respect to the top barrier 16. In addition, the insert plate 100 may be provided between the measurement chamber 14 and the bottom chamber 22 to limit unseating of the bottom barrier 20 from the indented seat 35, in the same configuration as described above with respect to the top barrier 16.

Figure 39:
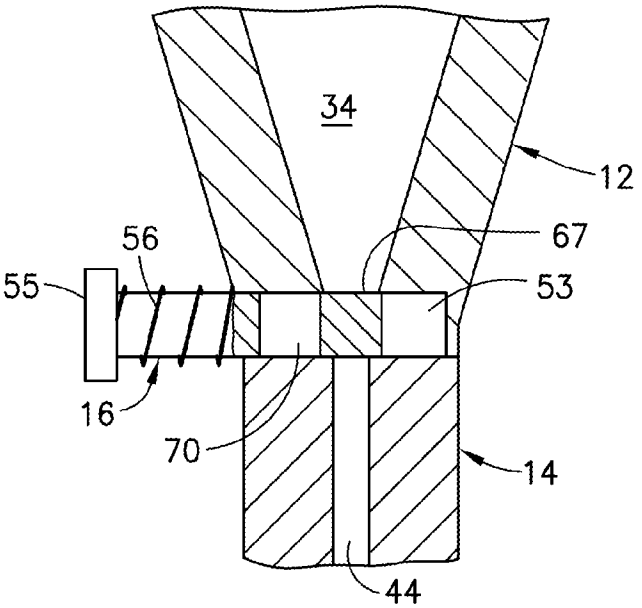
Figure 40:
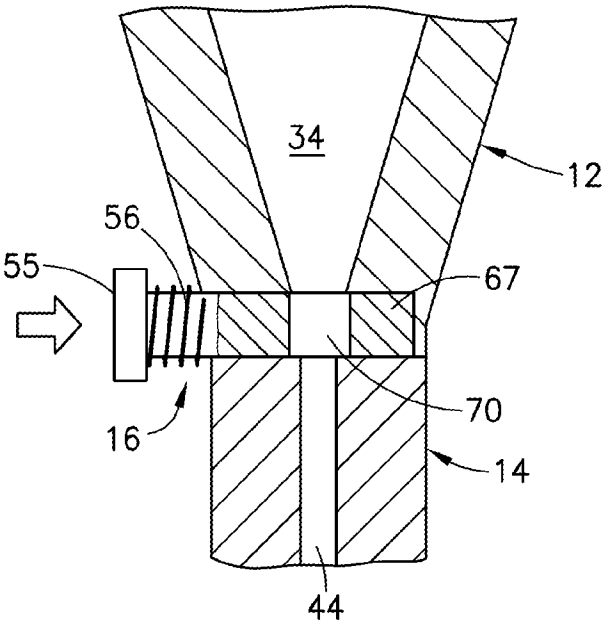

As will be appreciated by those skilled in the art, the top barrier 16 and/or the bottom barrier 20 may be formed with various configurations operable with the subject invention. For example, the top barrier 16 and/or the bottom barrier 20 may be configured as shown in FIGS. 28-35 and configured to have a normally (unactuated) closed state (FIG. 39), with a solid portion 67 of the top barrier 16 and/or the bottom barrier 20 being situated to block the conduit 44. With actuation, the top barrier 16 and/or the bottom barrier 20 may be axially shifted to align barrier opening 70 with the conduit 44, thus, urging the top barrier 16 and/or the bottom barrier 20 to an open state with the barrier opening 70 being in alignment with, and exposing, the conduit 44. The biasing means 56 may be used to urge the top barrier 16 and/or the bottom barrier 20 to the normally closed state.

As will be further appreciated by those skilled in the art, the biasing means 58 are not required for use with the top barrier 16 and/or the bottom barrier 20, as shown in FIGS. 36 and 37. Manual force may be used to axially shift the top barrier 16 and/or bottom barrier 20 between open and closed states. Preferably, cut-outs or other features are provided to provide some retaining force for retentively holding the top barrier 16 and/or the bottom barrier 20 in the open and/or closed states, with such force being surmountable to allow for axial shifting.

Figure 16:
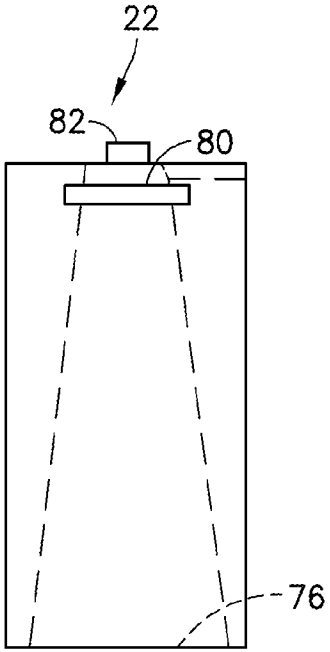
Figure 13:
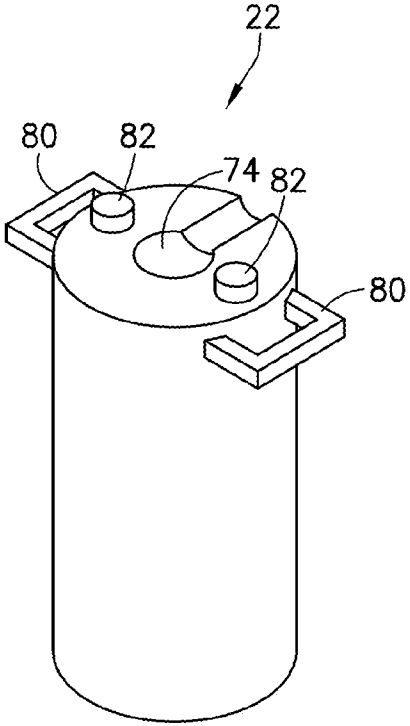

The bottom chamber 22 may be provided for use with the medicament dispenser 10. The bottom chamber 22 may be removably couplable (e.g., threaded engagement, snap engagement, bayonet lock, mechanical interaction, etc.) to the bottom end 50 of the measurement chamber 14. For example, a mounting wall 160 may be provided to protrude from the bottom end 50. The mounting wall 160 may define a recess 162 to accommodate the insert plate 100, if utilized. A lock opening 164 may be provided to accommodate the tab 106 of the insert plate 100. Inner surface 166 may be threaded to allow for threaded mounting of the bottom chamber 22 to the measurement chamber 14. The bottom chamber 22 may be formed with aperture 74 which is alignable with dispense opening 68 with the bottom chamber 22 being coupled to the measurement chamber 14. In this manner, the bottom chamber 22 may receive the defined number of solid medicinal units 36. The bottom chamber 22 may be cup-shaped to contain the solid medicinal units 36 therein or formed with a bottom aperture 76 (shown in FIG. 16) that allows for further dispensing or handling. A barrier or other adjustable closure may be provided for the bottom aperture 76.

The holding hopper 12, the measurement chamber 14 and the bottom chamber 22 may be provided with various elements for coupling. As shown in the Figures, snap-engagement elements 78 with corresponding brackets 80 may be utilized. Other configurations are possible. Also, cooperating detents 82 and depressions 84 may be provided on the elements to enhance stability of coupling once coupled.

Figure 41:
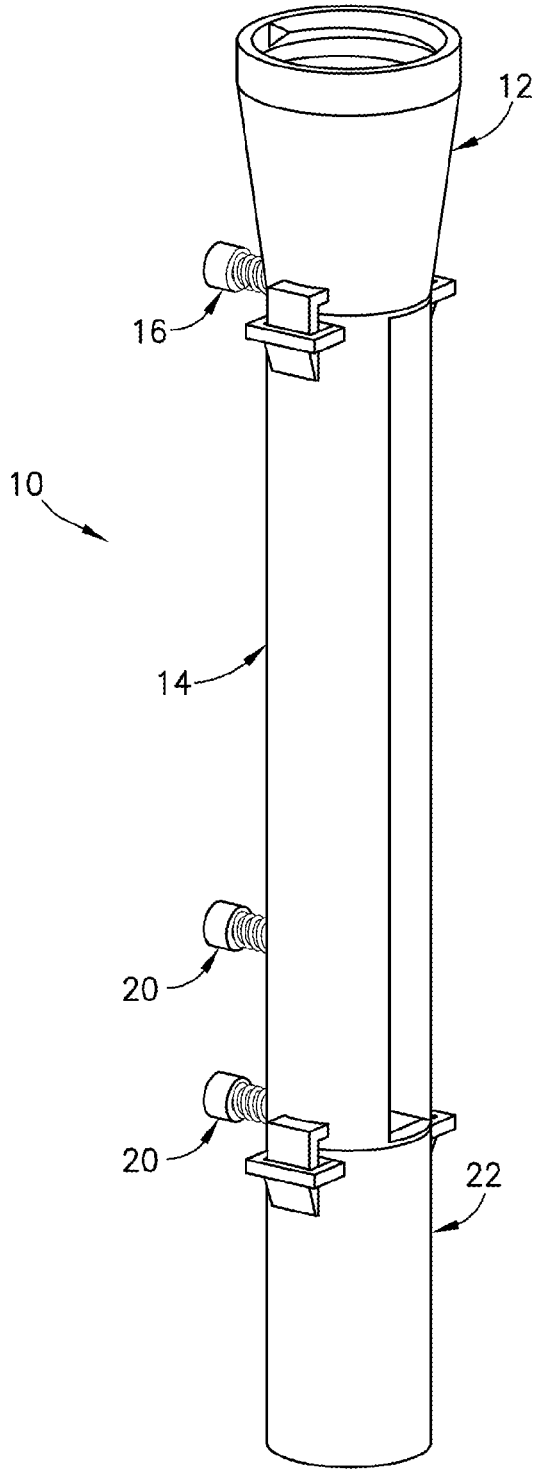

With reference to FIG. 41, the medicament dispenser 10 may be provided with a plurality of the bottom barriers 20 spaced along the length of the measurement chamber 14. In this manner, the length of the conduit 44 may be altered to less than the full length of the length L. This allows for accommodation of a lessened, but known, target number of the solid medicinal units 36. The positions of the bottom barriers 20 define varying lengths of the conduit 44, thereby allowing for variability in collecting target number of samples of the solid medicinal units 36. The bottom barriers 20 are placed into open/closed positions as needed to fill the desired length of the conduit 44.

Figure 42:
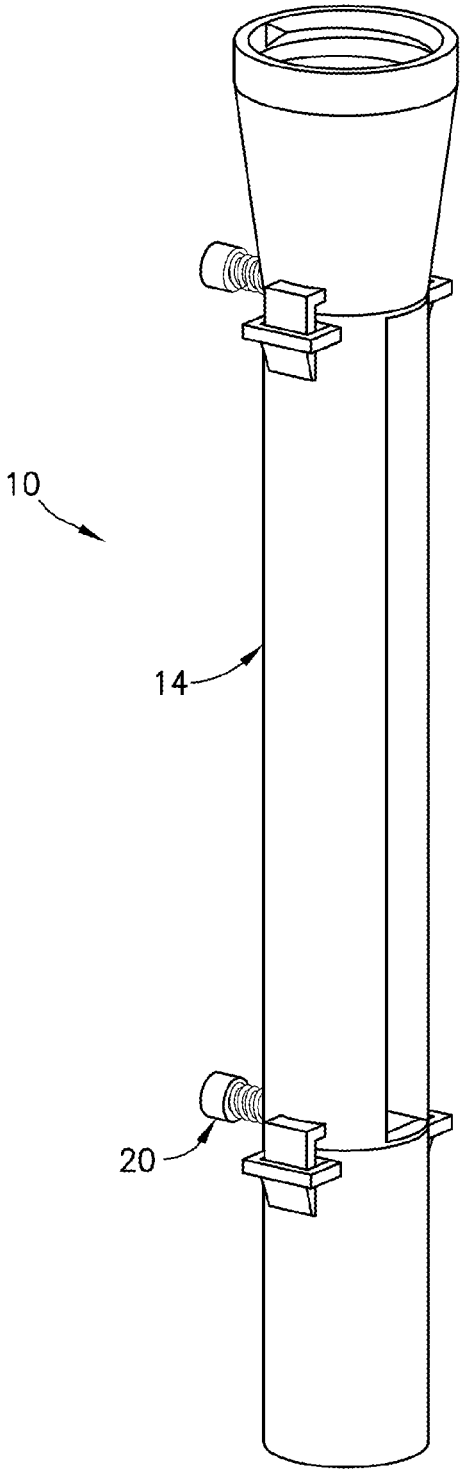
Figure 43A:
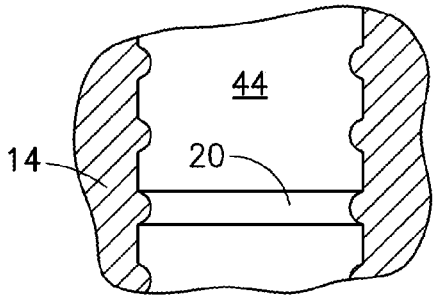
Figure 43B:
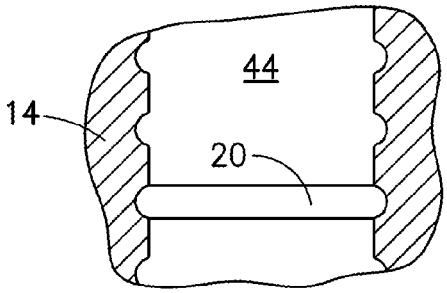
Figure 43C:
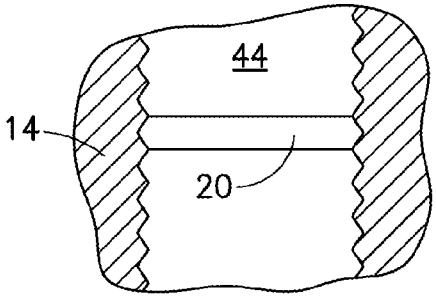

With reference to FIG. 42, optionally, one or more of the bottom barriers 20 may be formed to be height adjustable to allow movement of the respective bottom barrier 20 along the length of the conduit 44. In this manner, the movement of the bottom barrier 20 allows for adjusting the length of the conduit 44 to less than the full length of the length L. As will be appreciated by those skilled in the art, the bottom barrier 20 may be formed to be adjustable relative to the measurement chamber 14 in any known manner. With reference to FIGS. 43A-43C, cooperating detents/notches, teeth, ratchet arrangements, and the like, may be provided on the measurement chamber 14 and/or the bottom barrier 20 to allow for axial shifting of the bottom barrier 20 along the length of the conduit 44 with releasable retention at fixed locations.

Figure 44:
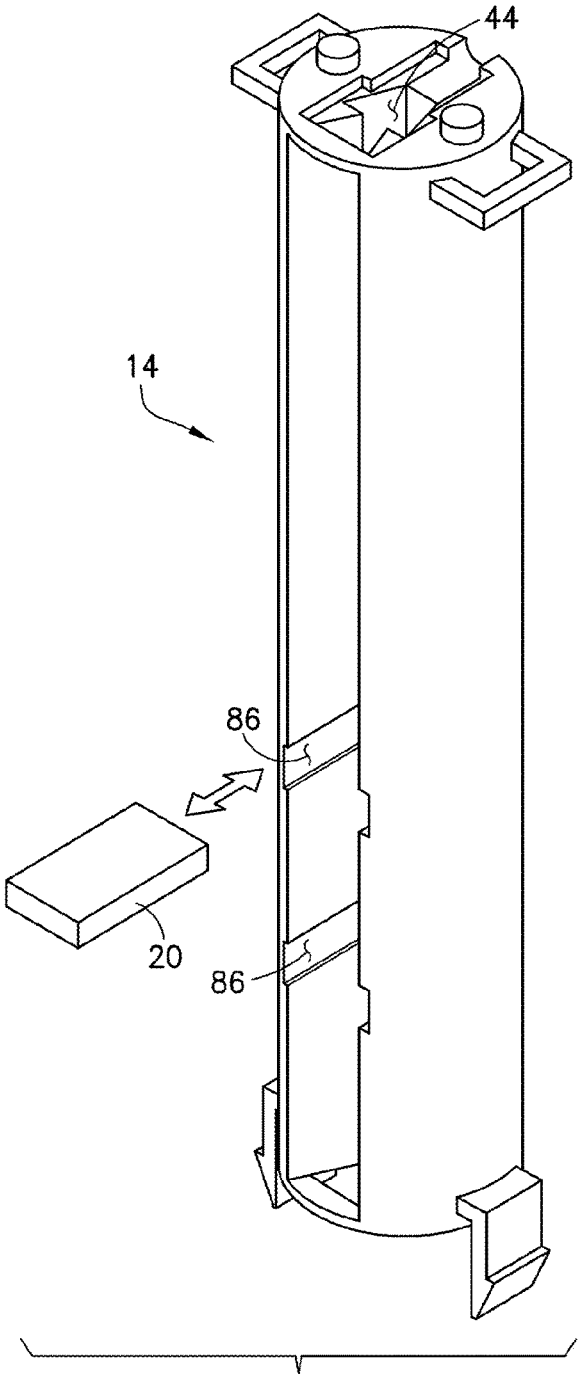
Figure 45:
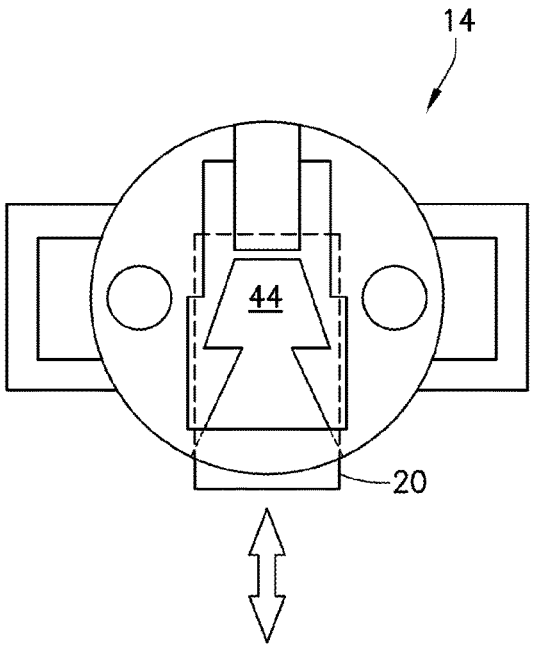
Figure 46:
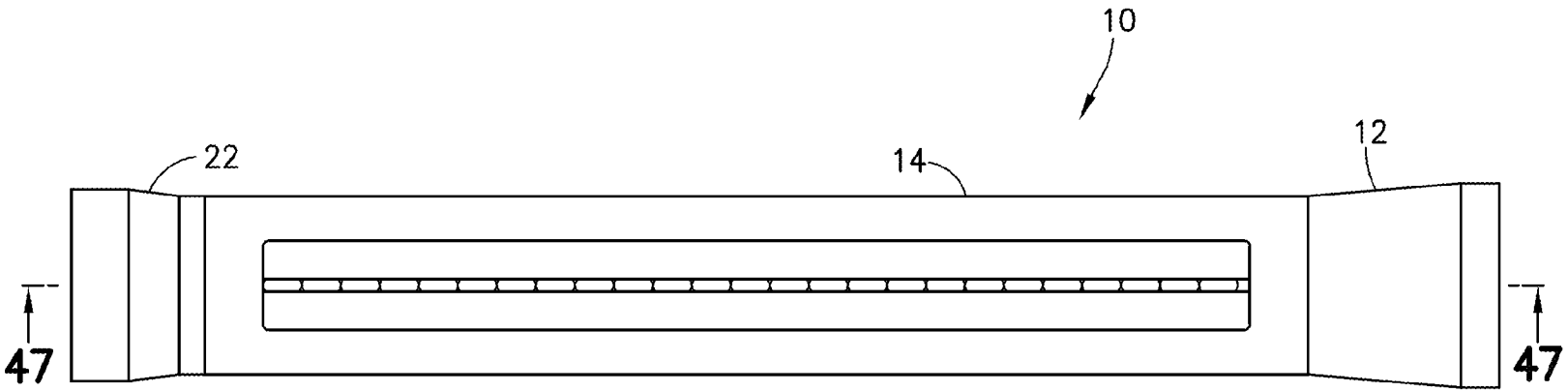
Figure 47:
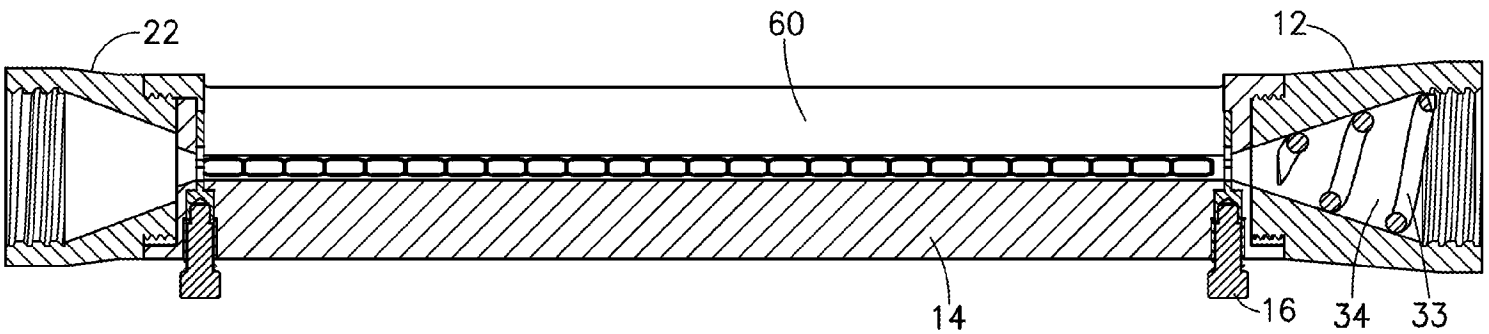
Figure 48:
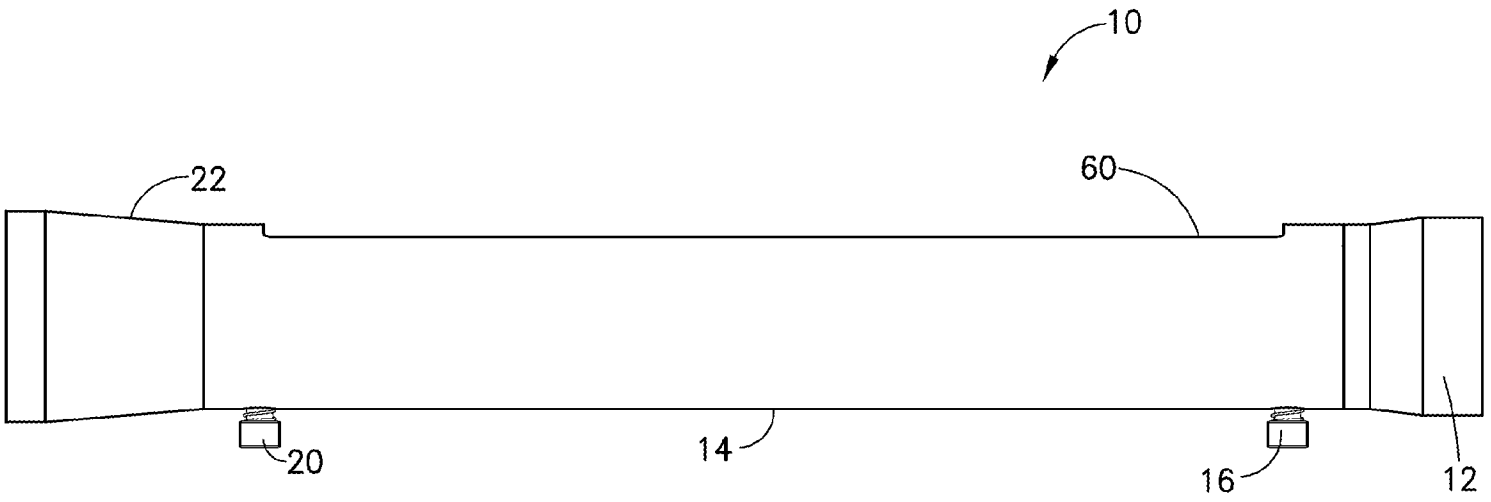

With reference to FIGS. 44-45, the bottom barrier 20 may be provided as a removable plate which is receivable in notched pockets 86 formed in the measurement chamber 14 and located along the length of the conduit 44. The notched pockets 86 define varying lengths of the conduit 44. With this arrangement, the bottom barrier 20 is formed with sufficient length to close off the conduit 44 and extend from the measurement chamber 14 when located in any of the notched pockets 86. This facilitates manual grasping of the bottom barrier 20 and removal from one of the notched pockets 86 and placement in a different one of the notched pockets 86. This allows for manual adjustment of the length of the conduit 44, thereby allowing for an alteration in the target number of the solid medicinal units 36 to be collected.

With a plurality or adjustability of the bottom barrier(s) 20, indicia or other markings may be provided on the measurement chamber 14 to indicate the number of the solid medicinal units 36 to be accommodated in the conduit 44 with the bottom barrier 20 at a given location.

Figure 60:
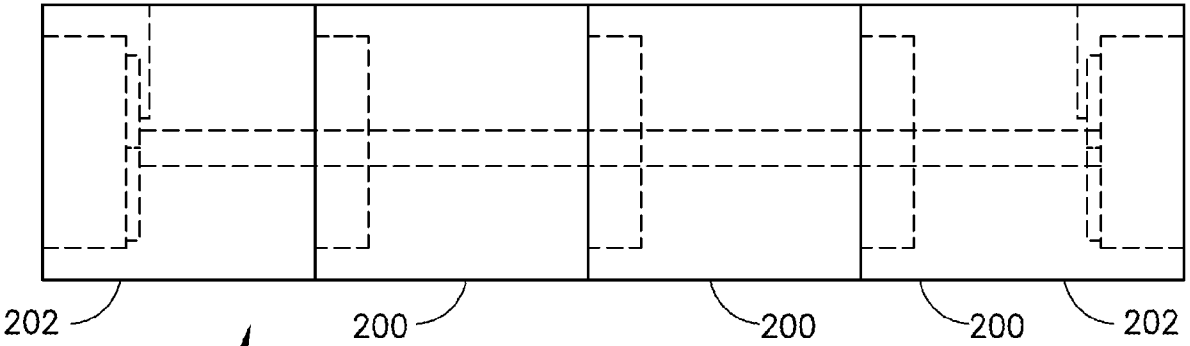
Figure 61:
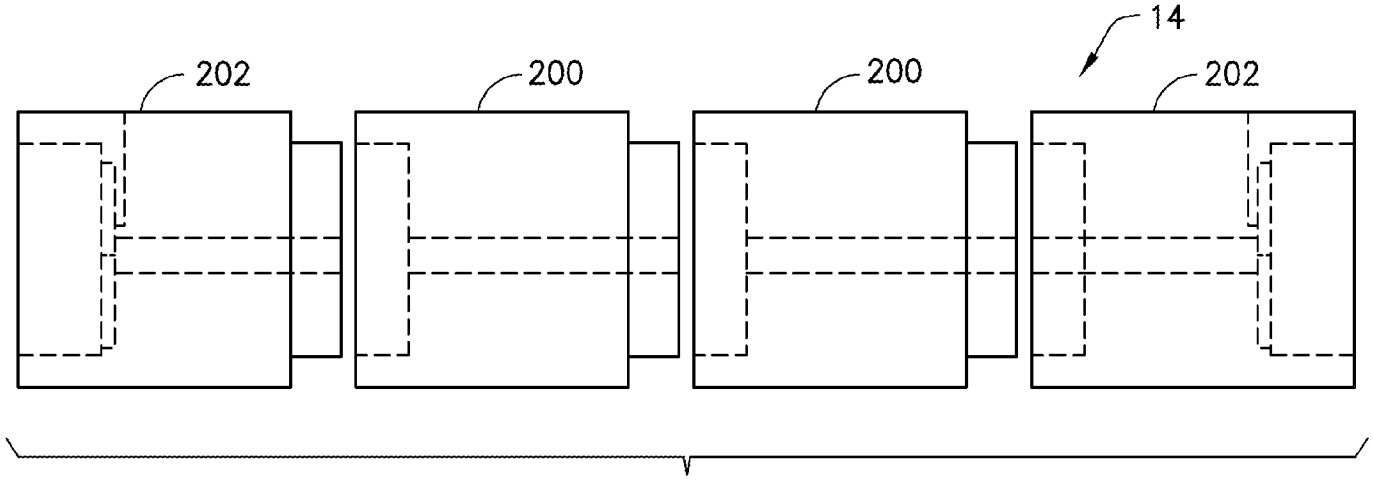

With reference to FIGS. 60 and 61, in a further embodiment of the subject invention, the measurement chamber 14 may be formed modular to allow for varying lengths. Modules 200 may be provided of different lengths which are axially couplable to collectively define the measurement chamber 14. End caps 202 may be provided to mount to the ends of an assembly of the modules 200 to complete the measurement chamber 14. The end caps 202 may be provided with features described above in connection with the top and bottom ends 48, 50, e.g., to permit mounting thereto of the holding hopper 12 and the bottom chamber 22 and/or to accommodate the top and bottom barriers 16, 20. With this embodiment, by providing different quantities of the modules 200 and/or different length modules 200. an inventory of the modules 200 may be provided which allows for varying the length of the measurement chamber 14, thereby allowing for accommodating different quantities of the total medicinal units 36. The modules 200 and the end caps 202 may be formed with different forms of connection and, optionally, male/female cooperating elements to permit axial stability to the assembly thereof.

It is further possible to provide an inventory of the measurement chambers 14 in different lengths and/or differently configured conduits 44 to permit a user flexibility in accommodating different quantities and differently configured solid medicinal units 36.

The present medicament dispenser and aforementioned components can be made from any suitable materials, such as plastic, metal including stainless steel and aluminum, wood, ceramic, and etc., with any process known to one skilled in the art.

What is claimed is:

1. A medicament dispenser for solid medicinal units comprising:

a holding hopper having a wide opening end and a narrow opening end;

a measurement chamber having a conduit with a top opening end and a bottom opening end, wherein the top opening end is aligned with the narrow opening end of the holding hopper;

a top barrier which is located between the narrow opening end of the holding hopper and the top opening end of the measurement chamber, and is movable between a closed position and an open position; and at least one bottom barrier which is spaced from the top barrier along the conduit of the measurement chamber, the at least one bottom barrier being movable between a closed position and an open position, wherein, the at least one bottom barrier is adjustable along the conduit to various positions to define different spacings with the top barrier, the different spacings corresponding to different quantities of the solid medicinal units.

2. The medicament dispenser of claim 1, further comprising an exchangeable cartridge which has an outside contour and an inside groove and is insertable into the conduit of the measurement chamber, wherein the inside groove has a shape and dimension to align the solid medicament units in one orientation.

3. The medicament dispenser of claim 1, which further comprises a bottom chamber with a top opening end and a bottom end, wherein the top opening end of the bottom chamber is aligned with the bottom opening end of the measurement chamber, and a first of the at least one bottom barrier is located between the bottom opening of the measurement chamber and the top opening end of the bottom chamber.

4. The medicament dispenser of claim 1, wherein the wide opening end of the holding hopper has coupling means to affix a cap or a container thereto.

5. The medicament dispenser of claim 1, which further comprises one or more coupling means.

6. The medicament dispenser of claim 1, wherein the measurement chamber further comprises a visualization window.

7. The medicament dispenser of claim 1, wherein the top barrier and the at least one bottom barrier are manually actuated to move between an open position and a closed position.

8. The medicament dispenser of claim 1, wherein the top barrier and the at least one bottom barrier, when not actuated, are at closed positions blocking the conduit of the measurement chamber.

9. The medicament dispenser of claim 1, wherein the top barrier is a spring actuated sliding gate.

10. The medicament dispenser of claim 1, wherein the at least one bottom barrier is a spring actuated sliding gate.

11. The medicament dispenser of claim 1, wherein the conduit has a shape and dimension suitable for aligning the solid medicament units in one orientation.

12. The medicament dispenser of claim 1, wherein a plurality of bottom barriers are provided along the length of the conduit.

13. The medicament dispenser of claim 1, wherein the holding hopper has coupling means for removable mounting to the measurement chamber.

14. The medicament dispenser of claim 1, wherein the measurement chamber is modularly formed by a plurality of axially coupled modules.

15. A method of counting or dispensing a defined number of solid medicament units, comprising:

providing a medicament dispenser including a holding hopper, a measurement chamber having a conduit with a top opening and a bottom opening, a top barrier, and a first bottom barrier;

positionally adjusting the first bottom barrier along the conduit to define a spacing relative to the top barrier to accommodate the defined number of the solid medicament units;

accumulating a sample of the solid medicament units in the holding hopper;

with the first bottom barrier in a closed position, actuating the top barrier to move from a closed position to an open position to allow the solid medicament units to flow from the holding hopper into the measurement chamber;

agitating the sample of solid medicament units in the holding hopper when actuating the top barrier to move from the closed position to the open position;

actuating the top barrier to move from the open position to the closed position to stop the solid medicament units from flowing from the holding hopper into the measurement chamber, wherein the defined number of the solid medicinal units are located between the top barrier, in the closed position, and the first bottom barrier, in the closed position, within the measurement chamber;

actuating the first bottom barrier to move from the closed position to an open position to dispense the defined number of the solid medicament units from the measurement chamber.

16. The method of claim 15, wherein a cap or container is affixed to the holding hopper when the sample of solid medicament units is agitated.

17. The method of claim 15, further comprising adjusting the first bottom barrier prior to actuating the top barrier to move from the closed position to the open position.

18. The method of claim 15, wherein the defined number of solid medicament units is dispensed to a bottom chamber coupled to the measurement chamber.

19. The method of claim 15, wherein the measurement chamber contains an exchangeable cartridge inserted in the conduit, and the exchangeable cartridge has an outside contour and an inside groove.

20. The method of claim 19, wherein the defined number of solid medicament units stack in the inside groove of the exchangeable cartridge.

21. The method of claim 15, wherein the defined number of the solid medicament units is dispensed from the measurement chamber to a bottom chamber with a top opening end and a bottom end, wherein the top opening end of the bottom chamber is coupled to the bottom opening end of the measurement chamber.

22. The method of claim 19, further comprising viewing the solid medicament units in the conduit or the inside groove through a visualization window on the measurement chamber prior to actuating the first bottom barrier to move from the closed position to the open position.

23. A medicament dispenser kit comprising a holding hopper having a wide opening end and a narrow opening end;

a plurality of measurement chambers each having a conduit with a top opening end and a bottom opening end, and at least one bottom barrier which is movable between a closed position and an open position, wherein the top opening end of each of the plurality of measurement chambers is alignable with the narrow opening end of the holding hopper, wherein the lengths of the conduits of the plurality of measurement chambers are different; and a top barrier, movable between a closed position and an open position, between the narrow opening end of the holding hopper and the top opening of the measurement chamber.

24. The medicament dispenser kit of claim 23, wherein for each of the plurality of measurement chambers, a plurality of bottom barriers are provided along the length of the respective conduit.

25. The medicament dispenser kit of claim 23, wherein the different lengths of the plurality of measurement chambers each provide for measuring different defined quantities of the solid medicament units.

26. The medicament dispenser kit of claim 23, further comprising one or more exchangeable cartridges insertable to the conduit of the measurement chamber.

27. The medicament dispenser kit of claim 26, wherein the one or more exchangeable cartridges each has an outside contour and an inside groove, where the outside contour has a shape and dimension fitting to the conduit of the measurement chamber, and the inside groove has a shape and dimension suitable to measure a defined number of solid medicament units.

28. The medicament dispenser kit of claim 23, further comprising a bottom chamber with a top opening end and a bottom end, wherein the top opening end of the bottom chamber is affixable to the bottom opening end of the measurement chamber.

29. The medicament dispenser kit of claim 23, further comprising a cap or a container affixable to the wide opening end of the holding hopper.

30. The medicament dispenser kit of claim 23, wherein the holding hopper and the measurement chamber each further comprises one or more coupling means.

31. The medicament dispenser kit of claim 23, further comprising a bottom chamber affixable to the measurement chamber.

32. The medicament dispenser kit of claim 31, wherein the bottom chamber further comprises one or more coupling means.

33. A medicament dispenser for solid medicinal units comprising:

a holding hopper having a wide opening end and a narrow opening end;

a measurement chamber having a conduit with a top opening end and a bottom opening end, wherein the top opening end is aligned with the narrow opening end of the holding hopper;

a top barrier which is located between the narrow opening end of the holding hopper and the top opening end of the measurement chamber, and is movable between a closed position and an open position; and at least one bottom barrier which is adjustable along the length of the conduit to define different spacings with the top barrier, and is movable between a closed position and an open position.

34. The medicament dispenser of claim 33, which further comprises a bottom chamber with a top opening end and a bottom end, wherein the top opening end of the bottom chamber is coupled to the bottom opening end of the measurement chamber.

35. The medicament dispenser of claim 33, wherein the wide opening end of the holding hopper has coupling means to affix a cap or a container thereto.

36. The medicament dispenser of claim 33, wherein the top barrier and the at least one bottom barrier are manually actuated to move between an open position and a closed position.

37. The medicament dispenser of claim 33, wherein the top barrier and the at least one bottom barrier, when not actuated, are at closed position blocking the conduit of the measurement chamber.

38. The medicament dispenser of claim 33, wherein the top barrier is a spring actuated sliding gate.

39. The medicament dispenser of claim 33, wherein the at least one bottom barrier is a spring actuated sliding gate.

40. The medicament dispenser of claim 33, wherein the spacing between the top barrier and the at least one bottom barrier is dimensioned for measuring a defined number of the solid medicament units.

41. The medicament dispenser of claim 33, wherein the measurement chamber and the at least one bottom barrier are provided with means which allows for axial shifting of the at least one bottom barrier along the length of the conduit and releasable retention at fixed locations.

42. A medicament dispenser for solid medicinal units comprising:

a holding hopper having a wide opening end and a narrow opening end;

a measurement chamber having a conduit with a top opening end and a bottom opening end, one or more notched pockets being formed in the measurement chamber along the length of the conduit, wherein the top opening end is aligned with the narrow opening end of the holding hopper;

a top barrier which is located between the narrow opening end of the holding hopper and the top opening end of the measurement chamber, and is movable between a closed position and an open position; and a first removable bottom barrier formed to be removably received in one or more of the notched pockets to close off the conduit.

43. The medicament dispenser of claim 42, which further comprises a bottom chamber with a top opening end and a bottom end, wherein the top opening end of the bottom chamber is coupled to the bottom opening end of the measurement chamber.

44. The medicament dispenser of claim 42, wherein the wide opening end of the holding hopper has coupling means to affix a cap or a container thereto.

45. The medicament dispenser of claim 42, wherein the top barrier is manually actuated to move between an open position and a closed position.

46. The medicament dispenser of claim 42, wherein the top barrier is a spring actuated sliding gate.

47. The medicament dispenser of claim 42, wherein the first removable bottom barrier is plate shaped.

48. The medicament dispenser of claim 42, wherein the length of the conduit between the top barrier and the first removable bottom barrier is dimensioned for measuring a defined number of the solid medicament units.

49. The medicament dispenser of claim 42, wherein the first removable bottom barrier extends from the measurement chamber when removably received in one or more of the notched pockets.

50. A method of counting or dispensing a defined number of solid medicament units, comprising:

providing a medicament dispenser including a holding hopper, a measurement chamber having a conduit with a top opening and a bottom opening, a top barrier, a first bottom barrier, and an exchangeable cartridge inserted in the conduit, wherein the exchangeable cartridge has an outside contour and an inside groove, wherein the inside groove has a shape and dimension to align the solid medicament units in one orientation;

positionally adjusting the first bottom barrier along the conduit to define a spacing relative to the top barrier to accommodate the defined number of the solid medicament units;

accumulating a sample of the solid medicament units in the holding hopper;

with the first bottom barrier in a closed position, actuating the top barrier to move from a closed position to an open position to allow the solid medicament units to flow from the holding hopper into the measurement chamber;

actuating the top barrier to move from the open position to the closed position to stop the solid medicament units from flowing from the holding hopper into the measurement chamber, wherein the defined number of the solid medicinal units are located between the top barrier, in the closed position, and the first bottom barrier, in the closed position, within the measurement chamber;

actuating the first bottom barrier to move from the closed position to an open position to dispense the defined number of the solid medicament units from the measurement chamber.

51. The method of claim 50, further comprising adjusting the first bottom barrier prior to actuating the top barrier to move from the closed position to the open position.

52. The method of claim 50, wherein the defined number of solid medicament units is dispensed to a bottom chamber coupled to the measurement chamber.

53. The method of claim 50, wherein the defined number of solid medicament units stack in the inside groove of the exchangeable cartridge.

54. The method of claim 50, wherein the defined number of the solid medicament units is dispensed from the measurement chamber to a bottom chamber with a top opening end and a bottom end, wherein the top opening end of the bottom chamber is coupled to the bottom opening end of the measurement chamber.

55. The method of claim 50, further comprising viewing the solid medicament units in the conduit or the inside groove through a visualization window on the measurement chamber prior to actuating the first bottom barrier to move from the closed position to the open position.

56. The method of claim 50, further comprising agitating the sample of solid medicament units in the holding hopper when actuating the top barrier to move from the closed position to the open position.

57. The method of claim 56, wherein a cap or container is affixed to the holding hopper when the sample of solid medicament units is agitated.

* * * * *